US012781355B2

(12) United States Patent
Sargent et al.

(10) Patent No.: US 12,781,355 B2
(45) Date of Patent: Nov. 3, 2026

(54) METHODS AND SYSTEMS FOR ELECTROLYZING HYDROCARBONS COUPLED WITH CO2 CAPTURE

(71) Applicant: Northwestern University, Evanston, IL (US)

(72) Inventors: Edward Hartley Sargent, Glencoe, IL (US); Rong Xia, Evanston, IL (US); Ke Xie, Evanston, IL (US)

(73) Assignee: Northwestern University, Evanston, IL (US)

( * ) Notice: Subject to any disclaimer, the term of this patent is extended or adjusted under 35 U.S.C. 154(b) by 0 days.

(21) Appl. No.: 18/971,453

(22) Filed: Dec. 6, 2024

(65) Prior Publication Data

US 2025/0188624 A1 Jun. 12, 2025

Related U.S. Application Data

(60) Provisional application No. 63/607,143, filed on Dec. 7, 2023.

(51) Int. Cl.

| | |
|---|---|
| ***C25B 3/07*** | (2021.01) |
| ***C25B 3/23*** | (2021.01) |
| ***C25B 3/26*** | (2021.01) |
| ***C25B 9/23*** | (2021.01) |
| ***C25B 11/081*** | (2021.01) |

(52) U.S. Cl.

CPC ..... *C25B 3/07* (2021.01); *C25B 9/23* (2021.01); *C25B 11/081* (2021.01)

(58) Field of Classification Search

CPC ..... C25B 3/07; C25B 3/23; C25B 3/26

USPC ..... 205/413, 455

See application file for complete search history.

(56) References Cited

U.S. PATENT DOCUMENTS

| | | | | |
|---|---|---|---|---|
| 2013/0105330 | A1* | 5/2013 | Teamey | C25B 13/08 205/349 |
| 2022/0170171 | A1* | 6/2022 | Tahmasebi | C25B 9/21 |
| 2025/0137150 | A1* | 5/2025 | Kidder | C25B 3/03 |

FOREIGN PATENT DOCUMENTS

| | | | | |
|---|---|---|---|---|
| FR | 3131923 | A1 * | 7/2023 | C25B 3/23 |
| WO | WO-2024110373 | A1 * | 5/2024 | C10K 1/005 |

OTHER PUBLICATIONS

Lum et al., "Tuning OH Binding Energy Enables Selective Electrochemical Oxidation of Ethylene to Ethylene Glycol," Nature Catalysis (Jan. 2020), vol. 3, No. 1, pp. 14-22. (Year: 2020).*

(Continued)

*Primary Examiner* — Edna Wong

(74) *Attorney, Agent, or Firm* — Bell & Manning, LLC

(57) ABSTRACT

Methods and systems for the electrosynthesis of an oxidized product (e.g., ethylene glycol) from a hydrocarbon (e.g., ethylene) are provided. Electrosynthesis of the oxidized product is coupled with $CO_2$ capture in a catholyte, which may be subsequently released. An illustrative method comprises (a) delivering a cathode feed comprising $CO_2$ to a cathode in contact with a catholyte; (b) delivering an anode feed comprising a hydrocarbon to an anode in contact with an anolyte; and (c) generating hydroxide in the catholyte to dissolve $CO_2$ therein, while oxidizing the hydrocarbon in the anolyte, by generating a potential difference between the cathode and the anode.

14 Claims, 18 Drawing Sheets

(56) References Cited

OTHER PUBLICATIONS

Lee et al., "Acidic CO2 Electroreduction for High CO2 Utilization: Catalysts, Electrodes, and Electrolyzers," Nanoscale (2024), vol. 16, No. 5, pp. 2235-2249. (Year: 2024).*

Verma et al., "Co-Electrolysis of CO2 and Glycerol as a Pathway to Carbon Chemicals with Improved Technoeconomics Due to Low Electricity Consumption," Nature Energy (Jun. 2019), vol. 4, No. 6, pp. 466-474. (Year: 2019).*

Zhao et al., "Integrated Design for Electrocatalytic Carbon Dioxide Reduction," Catalysis Science & Technology (2020), vol. 10, No. 9, pp. 2711-2720. (Year: 2020).*

Wan Ru Leow et al., "Chloride-mediated selective electrosynthesis of ethylene and propylene oxides at high current density," *Science*(Jun. 12, 2020); pp .: 1228-1233.

Rong Xia et al., "Electrosynthesis of ethylene glycol from C1 feedstocks in a flow electrolyzer," *Nature Communications*(Jul. 29, 2023)14:4570.

* cited by examiner

METHODS AND SYSTEMS FOR ELECTROLYZING HYDROCARBONS COUPLED WITH CO2 CAPTURE

CROSS-REFERENCE TO RELATED APPLICATIONS

The present application claims benefit to U.S. provisional patent application No. 63/607,143 that was filed Dec. 7, 2023, the entire contents of which are incorporated herein by reference.

BACKGROUND

Ethylene glycol, an essential ingredient in antifreeze, polyester fibers, and plastic bottles, held a market size of 31.9 MMt in 2022. The prevailing production approach involves ethylene oxidation to ethylene oxide under elevated temperature and pressure (200-300° C., 1.5-2.5 MPa), which is subsequently hydrolyzed to produce ethylene glycol at 120-250° C. and 1-4 MPa. The production of ethylene glycol leads to over 46 million tonnes of $CO_2$ emissions annually. A substantial portion of these emissions stems from the production of ethylene—primarily via oil cracking—and the overoxidation during the synthesis of ethylene glycol.

SUMMARY

Methods and systems for the electrosynthesis of an oxidized product (e.g., ethylene glycol) from a hydrocarbon (e.g., ethylene) are provided. In the present methods and systems, electrosynthesis of the oxidized product is coupled with $CO_2$ capture in a catholyte, which may be subsequently released.

The methods and systems are illustrated below primarily by reference to oxidation of a specific hydrocarbon, ethylene, to ethylene glycol. Briefly, although other electrochemical processes have been developed for ethylene glycol manufacturing, they are impeded by challenges like ethylene overoxidation and low current density. The present methods and systems are illustrated in greater detail in the Examples below, which describe a single-electrolyzer system configured to couple chloride-mediated ethylene glycol electrosynthesis with carbon capture. First, the Examples describe experiments in which the role of pH gradients across membranes in regulating anodic ethylene partial oxidation is delineated. Next, experiments are presented which highlight how these pH gradients can be exploited for carbon capture and optimization of anodic partial oxidation conditions. Leveraging this knowledge, tin-doped ruthenium oxide catalysts were developed that enable selective ethylene partial oxidation under a near-neutral pH. Surprisingly, the integrated approach attains up to 94% Faradaic efficiency for ethylene glycol production along with 92% carbon capture efficiency when $CO_2$ concentrations vary between 1% and 10% in a feeding gas stream containing 20% $O_2$ and 70-79% $N_2$. Operating at a full cell voltage of 1.8 V and a current density of 100 mA $cm^{-2}$, the system requires only 6.9 GJ/tonne of energy to produce one tonne of ethylene glycol while capturing 0.75 tonnes of $CO_2$. This is a marked reduction from the conventional 22.6 GJ. The cradle-to-grave life cycle assessment reveals a tenfold carbon footprint reduction to 0.11 tonnes $CO_2$-eq/tonne with oil-cracking ethylene. Further integration of $CO_2$ electroreduction will result in a negative carbon footprint of −2.06 tonnes $CO_2$-eq per tonne. Given that global ethylene production accounts for 260 million tonnes of $CO_2$ emissions annually—approximately 0.8% of global emissions—the single-electrolyzer integrated system provides a transformative solution for both emission reduction and value-added chemical production.

A method for electrolyzing a hydrocarbon is provided that comprises (a) delivering a cathode feed comprising $CO_2$ to a cathode in contact with a catholyte; (b) delivering an anode feed comprising a hydrocarbon to an anode in contact with an anolyte; and (c) generating hydroxide in the catholyte to dissolve $CO_2$ therein, while oxidizing the hydrocarbon in the anolyte, by generating a potential difference between the cathode and the anode.

An electrolyzer for electrolyzing a hydrocarbon is provided, the electrolyzer comprising: a cathode in contact with a catholyte, the cathode comprising a catalyst that generates hydroxide in the catholyte to dissolve $CO_2$ therein upon generation of a potential difference between the cathode and an anode in electrical communication with the cathode; the anode in contact with an anolyte that dissolves a hydrocarbon therein, the anode comprising a catalyst that induces oxidation of the hydrocarbon in the anolyte upon generation of the potential difference between the cathode and the anode; a cathode feed inlet configured to deliver a cathode feed comprising $CO_2$ to the cathode; and an anode feed inlet configured to deliver an anode feed comprising the hydrocarbon to the anode.

Other principal features and advantages of the disclosure will become apparent to those skilled in the art upon review of the following drawings, the detailed description, and the appended claims.

BRIEF DESCRIPTION OF THE DRAWINGS

Illustrative embodiments of the disclosure will hereafter be described with reference to the accompanying drawings.

(FIG. 1A) The reaction mechanism of chloride-mediated ethylene partial oxidation in a membrane-electrode-assembly based electrolyzer. (FIG. 1B) The comparison of ethylene partial oxidation in a three-compartment flow electrolyzer and zero-gap membrane electrode assembly-based electrolyzer. An in-situ photoluminescence experiment to study the local pH on the membrane under the reaction condition was conducted (data not shown). (FIG. 1C) Rotating ring disk electrode (RRDE) experiment of $RuO_2$ under acidic (left) and neutral (right) conditions to differentiate oxygen evolution reaction and chloride oxidation reaction. (FIG. 1D) The cathodic pH when conducting hydrogen evolution reaction (HER) and carbon capture utilizing the $OH^-$ generated at the gas diffusion interface. Carbon capture was performed in a gas mixture of 10% $CO_2$, 20% $O_2$, and 70% $N_2$. (FIG. 1E) The anodic Faradaic efficiency of ethylene partial oxidation when coupled with hydrogen evolution reaction with carbon capture, respectively.

(FIG. 2A) X-ray photoelectron spectroscopy of $RuMO_x$ (M=Sn, V, Mn, W) catalysts. Scanning electron microscopy/energy dispersive x-ray spectroscopy images of $RuMO_x$ catalysts were obtained (data not shown). (FIG. 2B) Rotating ring disk electrode (RRDE) experiment of $RuMO_x$ catalysts under neutral conditions. (FIG. 2C) Ethylene chlorohydrin Faradaic efficiency for various catalysts. (FIG. 2D) Stability test of $RuSnO_x$ catalysts under neutral conditions. A Pourbaix diagram of $RuMO_x$ using Density Functional Theory (DFT)

calculations was obtained (not shown). The reaction coordinate of chloride oxidation on $RuSnO_x$ and $RuO_2$, respectively, was obtained (not shown).

FIGS. 3A-3E demonstrate the integration of ethylene glycol electrosynthesis with carbon capture. (FIG. 3A) Schematics of anodic ethylene partial oxidation coupled with carbon capture, harnessing electrochemically generated hydroxide at the cathode. (FIG. 3B) The carbon capture efficiency tested under conditions of 1%, 2.5%, 5%, and 10% $CO_2$ atmosphere. (FIG. 3C) In-situ kinetics NMR study of ethylene chlorohydrin hydrolysis under neutral conditions. (FIG. 3D) The Faradaic efficiency towards ethylene glycol production under various current densities and its corresponding cell voltage. (FIG. 3E) $CO_2$ regeneration rate at various current densities.

Figure 4A:
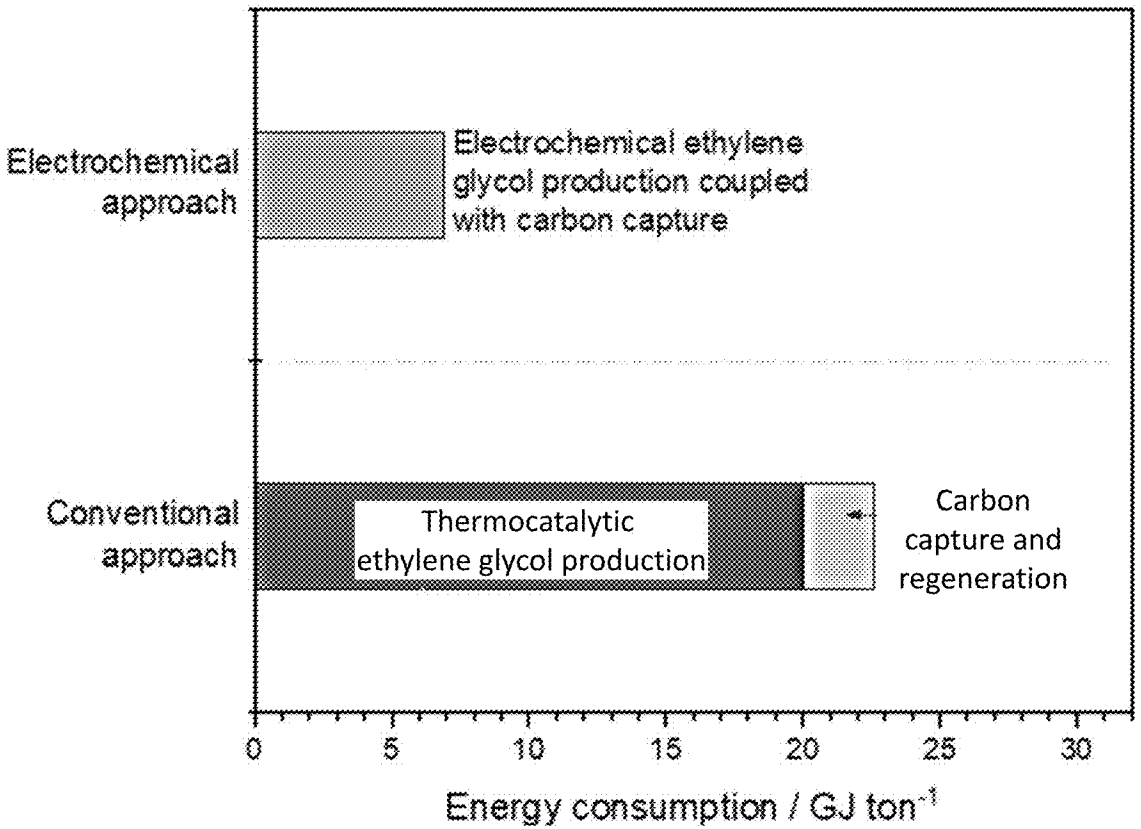
Figure 4B:
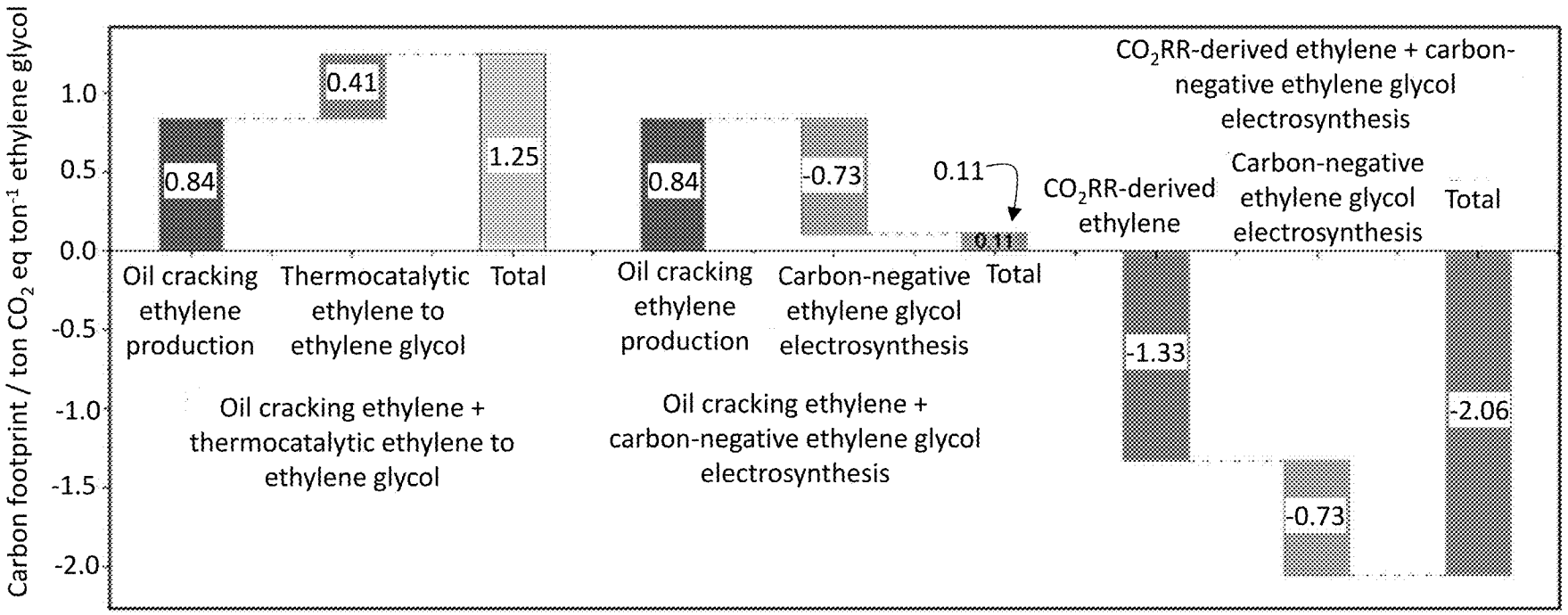
Figure 4C:
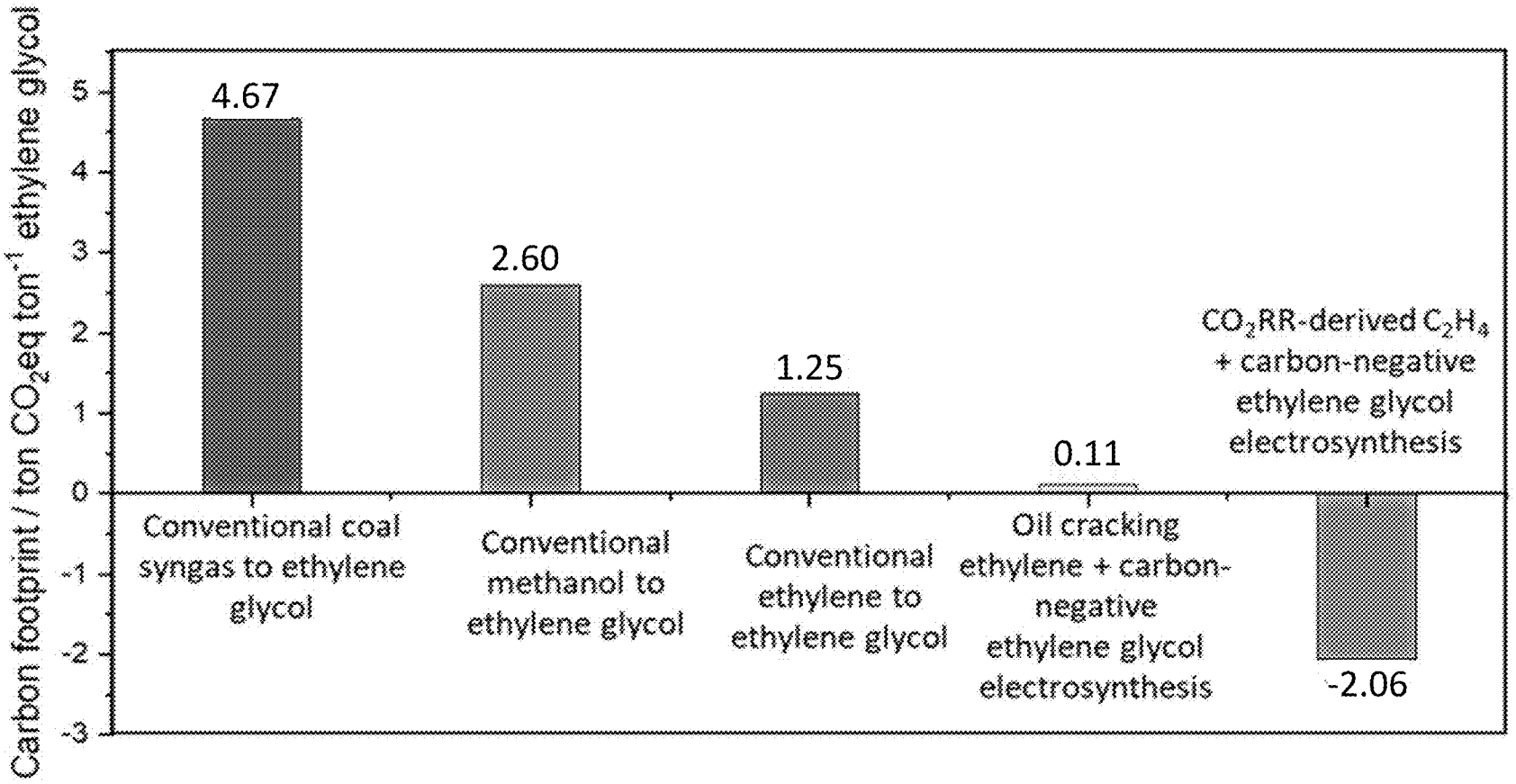

FIGS. 4A-4C compare the present carbon-negative ethylene glycol electrosynthesis methods with conventional ethylene glycol manufacturing. (FIG. 4A) Energy consumption of carbon-negative ethylene glycol production versus conventional ethylene glycol manufacturing coupled with liquid sorbent carbon capture. (FIG. 4B) The cradle-to-grave carbon footprint of oil-cracking ethylene production followed by thermocatalytic ethylene glycol manufacturing, oil-cracking ethylene production followed by carbon-negative ethylene glycol electrosynthesis, and $CO_2$-derived ethylene production through electrolysis followed by carbon-negative ethylene glycol electrosynthesis. (FIG. 4C) Comparison of the carbon footprint between carbon-negative ethylene glycol electrosynthesis and conventional production methods using coal, methanol, and oil-cracked ethylene. A techno-economic analysis of carbon-negative ethylene glycol electrosynthesis was conducted (not shown).

Figure 5:
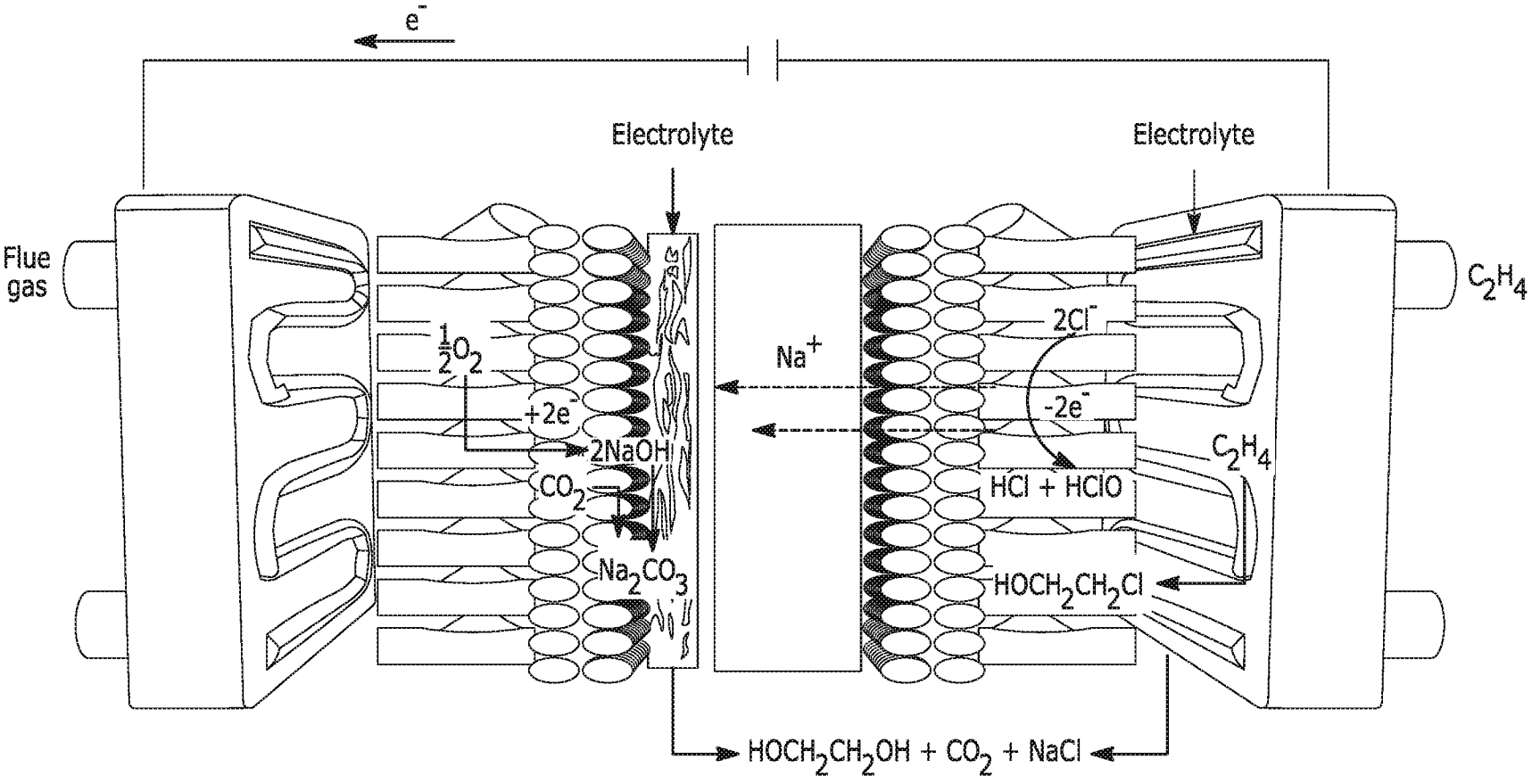

FIG. 5 shows a schematic of the approach of integrating anodic ethylene partial oxidation with cathodic carbon capture in a cation-exchange membrane-based microfluidic electrolyzer. The anode is in direct contact with membrane while there is a ~2 mm microfluidic channel between cathode and membrane to prevent salt precipitation.

Figure 6:
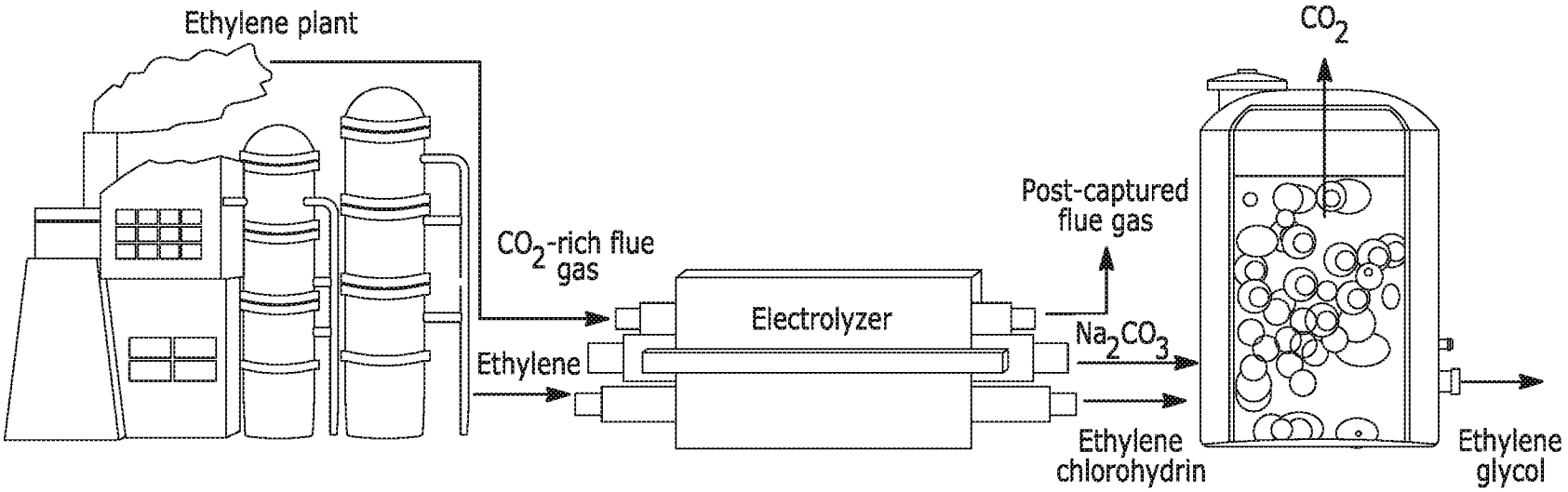

FIG. 6 shows a schematic of the approach of electrochemical ethylene glycol production coupled with carbon capture utilizing fossil fuel-derived ethylene.

DETAILED DESCRIPTION

The present methods are based on paired electrochemical reactions induced within an electrolyzer that facilitate $CO_2$ capture in a catholyte and oxidation, including selective oxidation, of a hydrocarbon in an anolyte. In a basic embodiment, a method for electrolyzing a hydrocarbon comprises delivering a cathode feed to a cathode in contact with a catholyte, the cathode feed comprising $CO_2$; delivering an anode feed to an anode in contact with an anolyte, the anode feed comprising a hydrocarbon; and generating hydroxide ($OH^-$) in the catholyte to dissolve $CO_2$ therein, while oxidizing the hydrocarbon in the anolyte. The method may further comprise releasing $CO_2$ gas from the catholyte while producing an oxidation product from the anolyte.

The composition of the catholyte, which is generally a liquid, is selected to facilitate the dissolution of $CO_2$ (from the cathode feed) therein. The dissolution of the $CO_2$ in the catholyte need not be perfect (i.e., 100%), but generally a substantial amount of the $CO_2$ is incorporated into the liquid catholyte. The catholyte is also selected to enable formation of the hydroxide therein via a reduction reaction taking place at the cathode, as further described below. The catholyte is further selected to enable formation of a carbonate therein, e.g., by providing a species that forms the carbonate with the dissolved $CO_2$. The catholyte may comprise (or consist of) water and a suitable salt. This salt may comprise the carbonate-forming species as well as a redox mediator for the partial oxidation of the hydrocarbon in the anolyte, as further described below. A suitable salt is an alkali metal halide salt, e.g., NaCl. The sodium cations can form $Na_2CO_3$ while the chlorine anions can be oxidized at the anode and serve as an effective redox mediator for partial oxidation of the hydrocarbon. However, other alkali metals (e.g., potassium) and other halides (e.g., bromide) may be used. The concentration of the salt in the catholyte may be adjusted as desired, e.g., to maximize $CO_2$ dissolution, maximize Faradaic efficiency and specificity, etc. Illustrative amounts are provided in the Examples, below. Components which may be excluded from the catholyte include those described below with respect to the anolyte, as well as an aldehyde (e.g., formaldehyde).

The cathode comprises a catalyst. Various catalysts that catalyze the reduction reaction at the cathode to generate the hydroxide during operation of the disclosed electrolyzers may be used, desirably with high Faradaic efficiency and specificity for hydroxide production. Generally, the reduction reaction is the oxygen reduction reaction. Desirably, the production of $H_2O_2$ is minimized. This includes the catholyte being free of $H_2O_2$, including during operation of the disclosed electrolyzers. In addition, the hydrogen evolution reaction at the cathode is desirably minimized. This includes the hydrogen evolution reaction not occurring at the cathode during operation of the disclosed electrolyzers. Illustrative catalysts that may be used include supported platinum catalysts (e.g., Pt/C) and iron-single-atom catalysts, the synthesis of which is described in the Examples, below. Other illustrative catalysts include those comprising Ni, Fe, Ru, Mn, and combinations thereof.

As noted above, the cathode feed comprises $CO_2$ to be captured in the catholyte as described above. Generally, the cathode feed also comprises $O_2$ which may be provided together with $CO_2$ as a gas mixture. Other gases may be present, e.g., $N_2$. The amounts of $CO_2$ (and $O_2$, if present) being fed may be adjusted as desired, e.g., to maximize Faradaic efficiency and specificity. Illustrative amounts are provided in the Examples below. For example, the $CO_2$ may be present in the cathode feed at an amount of at least 1% by volume, at least 2% by volume, at least 4% by volume, at least 6% by volume, at least 8% by volume, or in a range between any of these values, including from 1% to 10% by volume. In embodiments, the cathode feed comprises air, including air enriched with $CO_2$ at any of the disclosed amounts. In embodiments, the cathode feed consists of air, or $CO_2$ and one or more of $O_2$ and $N_2$.

The composition of the anolyte, which is also generally a liquid, is selected to facilitate the dissolution of the hydrocarbon (from the anode feed) therein. The dissolution of the hydrocarbon in the anolyte need not be perfect (i.e., 100%), but generally a substantial amount of the hydrocarbon is incorporated into the liquid anolyte. The anolyte is also selected to enables oxidation of the hydrocarbon via an oxidation reaction taking place at the anode. This oxidation reaction may involve the redox mediator noted above, i.e., anions which are oxidized at the anode to induce partial oxidation of the hydrocarbon to form an oxidation intermediate in the anolyte. Partial oxidation of a hydrocarbon is distinguished from full or complete oxidation of the hydrocarbon to $CO_2$ and $H_2O$. Suitable redox mediators include halides (e.g., $Cl^-$) although other halides and other redox mediators may be used. The anolyte may comprise (or consist of) water and any of the salts described above.

Additive(s) may be included, e.g., to facilitate hydrocarbon dissolution. The concentration of the salt (and additive(s), if present) in the anolyte may be adjusted as desired, e.g., to maximize hydrocarbon dissolution, maximize Faradaic efficiency and specificity, etc. Illustrative amounts are provided in the Examples, below. The composition of the anolyte and the catholyte may be the same or they may be independently selected. Components which may be excluded from the anolyte include those described above with respect to the catholyte, as well as an alcohol (e.g., methanol).

Figure 2A:
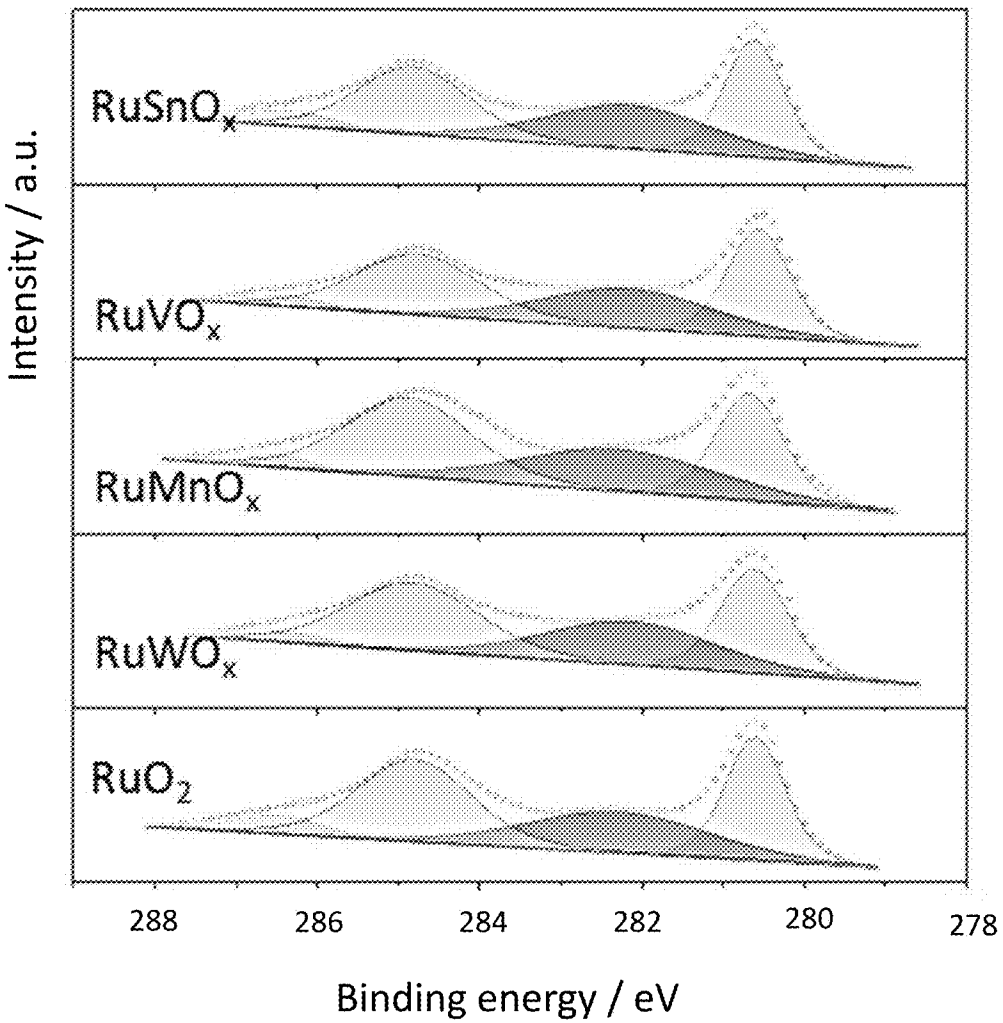
FIGS. 2A-2D demonstrate the use of $RuO_2$-based mixed oxide catalysts for enhanced ethylene partial oxidation selectivity under near-neutral conditions.

The anode comprises a catalyst. Various catalysts that catalyze the oxidation reaction at the anode (which may be the oxidation of the redox mediator as noted above), desirably with high Faradaic efficiency and specificity (including towards formation of the oxidation intermediate of the selected hydrocarbon). The catalyst also desirably exhibits high stability under acidic pH (e.g., below about 3). In embodiments, the catalyst is a mixed oxide catalyst comprising at least two transition metals, e.g., those selected from Ru, V, W, Mn, and Sn. The transition metal selection and relative amounts may be adjusted as desired, e.g., to maximize Faradaic efficiency and specificity. In embodiments, the mixed oxide catalyst is $RuMO_x$, wherein M is selected from V, W, Mn, and Sn. As demonstrated in the Examples, below, the mixed oxide catalyst $RuSnO_x$, in which Sn is incorporated into the $RuO_2$ structure, was found to significantly improve the Faradaic efficiency towards ethylene chlorohydrin (an oxidation intermediate) as well exhibit enhanced stability at low pH. (See FIG. 2C.) In embodiments, the anode may comprise a second catalyst, which may be useful for oxidizing certain hydrocarbons, e.g., methane. The second catalyst may be a thermocatalyst (as distinguished from an electrocatalyst).

As noted above, the anode feed comprises the hydrocarbon to be oxidized. A variety of hydrocarbons may be used. The hydrocarbon may be an olefin, e.g., ethylene, propylene, butene. In other embodiments, the hydrocarbon is an alkane, e.g., methane. The hydrocarbon may be unsubstituted, i.e., consisting of carbon and hydrogen and no heteroatoms. A single type of hydrocarbon or multiple, different types of hydrocarbons may be used. The amount of hydrocarbon in the anode feed may be adjusted analogous to the components of the cathode feed. In embodiments, the anode feed consists of the hydrocarbon to be oxidized, e.g., one or more unsubstituted olefins, unsubstituted alkanes.

As noted above, the present methods comprise generating hydroxide in the catholyte while oxidizing the hydrocarbon in the anolyte. This is accomplished by generating a potential difference between the cathode and the anode (which are in electrical communication with one another) sufficient to induce the reduction and oxidation reactions described herein. In this way, the electrochemical reactions are paired with one another and occur essentially simultaneously in the same electrolyzer. For this reason, the electrolyzer in which these paired electrochemical reactions are being carried out may be referred to as a "single-electrolyzer." As described above, the hydroxide may be generated via the oxygen reduction reaction and a carbonate may be formed in the catholyte. The hydrocarbon may be oxidized via a mediated partial oxidation reaction to form an oxidation intermediate in the anolyte.

The present methods may further comprise releasing $CO_2$ gas from the catholyte that had been incorporated therein, which may be accompanied by producing an oxidized product from the anolyte. The $CO_2$ gas release and production of the oxidized product may be accomplished by combining a portion of the catholyte and a portion of the anolyte to induce a reaction between the carbonate (from the catholyte) and the oxidation intermediate (from the anolyte) that produces the $CO_2$ gas and the oxidation product. The oxidation product may depend upon a pH of the combined catholyte and anolyte. Using ethylene chlorohydrin as an illustrative oxidation intermediate, the pH of the combined catholyte and anolyte may be tuned to provide ethylene glycol (at approximately neutral pH) or ethylene oxide (at more alkaline pH). Thus, the conditions (including the pH) under which the catholyte and the anolyte are combined may selected to provide a desired yield/selectivity of a desired oxidation product. The present methods may further comprise recovering the oxidation product from the combined catholyte and anolyte. The released $CO_2$ gas may be sequestered, if desired.

The present methods are carried out using an electrolyzer comprising (or consisting of) the cathode, the catholyte, anode, and the anolyte, each of which has been described above. The cathode and the anode are in electrical communication with each other such that the potential difference sufficient to induce the reduction and oxidation reactions described above may be generated therebetween. Various electrolyzer configurations may be used, comprising components and using arrangements typical of electrolyzers. The electrolyzer may be configured for continuous flow operation, i.e., involving continuously flowing catholyte and anolyte as well as continuous (or periodic) removal of portions of the catholyte and the anolyte. A separator may be included in the electrolyzer to separate the catholyte and the anolyte, e.g., an ion exchange membrane or a passive separator. In embodiments, an ion exchange membrane is used. In embodiments, the ion exchange membrane is a cation exchange membrane capable of allowing cations to pass therethrough while inhibiting the passage of hydroxide. In embodiments, the cathode, the anode, and the separator (e.g., ion exchange membrane) are configured to form a membrane electrode assembly (MEA), wherein the cathode is in direct contact with one side of the separator and the anode is in direct contact with an opposing side of the separator. The electrolyzers described herein are also encompassed by the present disclosure, which may be a component of an electrolyzer system. The electrolyzer system may further comprise a feed electrolyzer for providing the hydrocarbon to be oxidized, e.g., a feed electrolyzer configured to provide ethylene from the electrochemical reduction of $CO_2$. Other components that may be included in any of the disclosed electrolyzers include gas diffusion layers; flow field plates; a power source, etc.

In addition to the potential difference under which the present methods are carried out, other conditions such as temperature and pressure may be selected as desired, e.g., to maximize $CO_2$ dissolution, maximize hydrocarbon dissolution, maximize Faradaic efficiency and specificity (at the cathode and/or anode), etc. However, in embodiments, the present methods are carried out at room temperature and atmospheric pressure. Depending upon the selected hydrocarbon, higher temperatures and/or pressures may be used. The conditions used during the combining of the catholyte and the anolyte may be the same as used during the electrochemical reactions or they may be independently selected.

Figure 3A:
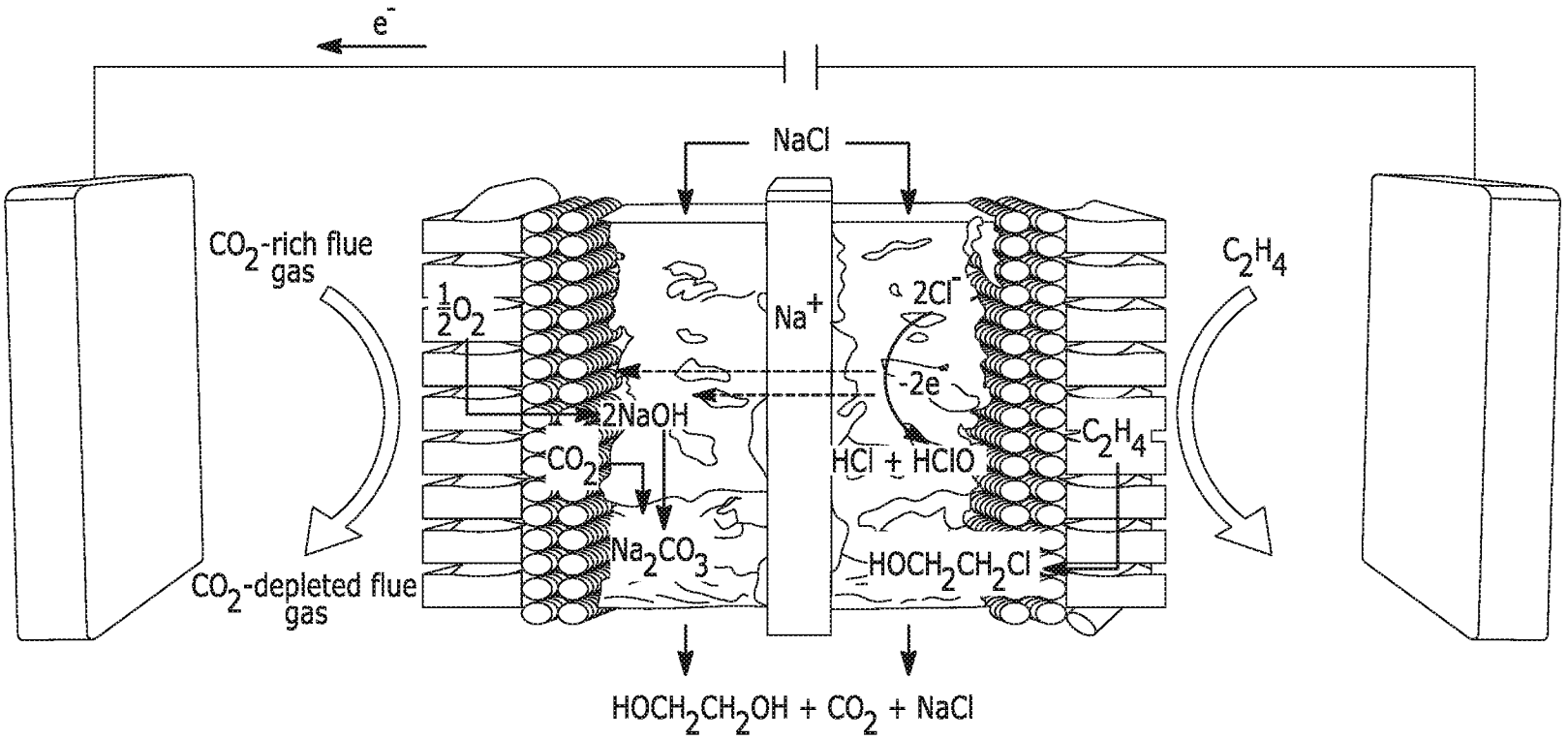

An illustrative electrolyzer and method of electrolyzing a hydrocarbon using the electrolyzer is shown in FIG. 3A and is further described in the Examples, below. As shown in FIG. 3A, the electrolyzer is configured to capture $CO_2$ while selectively oxidizing ethylene to ethylene chlorohydrin, and to release $CO_2$ while producing ethylene glycol from the combined catholyte and anolyte. Ethylene oxide may be produced by appropriate selection of conditions for the combined catholyte and anolyte.

Other electrolyzers and methods for electrolyzing other hydrocarbons are also encompassed. In embodiments, the present methods and systems are configured to oxidize propylene to propylene glycol, propylene oxide, or both (including via a propylene halohydrin oxidation intermediate). In embodiments, the present methods and systems are configured to oxidize butene to butenediol or butanediol (including via a butene halohydrin oxidation intermediate). In embodiments, the present methods and systems are configured to oxidize methane to methanol (including via a halomethane oxidation intermediate).

The present methods and systems may be characterized by various properties including $CO_2$ capture efficiency (e.g., at least 85%, at least 90%, at least 95%, or a range of between any of these values) and Faradic efficiency (e.g., at least 90%, at least 92%, at least 94%, or a range of between any of these values) towards a desired oxidation product (e.g., ethylene glycol from ethylene). These values may refer to specific operating conditions, e.g., from 1% to 10% by volume $CO_2$, 20% by volume $O_2$, balance $N_2$ in the cathode feed; a full cell voltage of 1.8 V; and a current density of 100 mA $cm^{-2}$.

The terms "selective," "specificity," and the like refer to the percentage of a reactant (e.g., any of the disclosed hydrocarbons) that goes toward the desired product (e.g., any of the disclosed oxidation intermediates or oxidation products). The selectivities/specificities referenced herein may be at least 90%, at least 95%, at least 98%, 100%, or a range of between any of these values. This includes the present methods achieving a selectivity/specificity of any of these values in the conversion of ethylene to ethylene glycol.

EXAMPLES

Example 1

Methods

Synthesis of Fe—N—C Catalyst

In a typical synthesis of N-doped carbon, a 400 mL methanol solution containing 9.04 g of $Zn(NO_3)_2 \cdot 6H_2O$ was poured into another 400 mL methanol solution containing 10.507 g of 2-methylimidazole, while stirring quickly. The mixture was stirred for 2 minutes and then kept in a stable condition for 1 day without further stirring. Afterward, the white precipitates were collected by centrifugation, washed with methanol three times, and dried in a vacuum oven at 70° C. To obtain N-doped carbon, the synthesized zeolitic imidazolate framework (ZIF-8) powders were ground and then subjected to heat treatment at 900° C. for 1 hour under Ar purging conditions in a tube furnace. Subsequently, 200 mg of N-doped carbon was dispersed in 40 mL of $H_2O$ and sonicated it for 20 minutes. Then, 1 mL of $Fe(NO_3)_3$ solution (prepared by dissolving 269.3 mg of iron nitrate in 10 mL of $H_2O$) was added to the dispersion and subjected to an additional 20 minutes of sonication, followed by continuous stirring for 24 hours. After filtration, the resulting precipitate was rinsed with deionized water and dried in a vacuum oven overnight. In the final step, the dried sample was pyrolyzed in the tube furnace at 1000° C. for 2 hours under an Ar atmosphere.

Material Characterization

Morphological characterization of the synthesized sample was performed by using a Transmission electron microscopy (TEM, JEOL JEM-2100F) at an acceleration voltage of 200 kV. High angle annular dark field-scanning TEM (HAADF-STEM) and energy dispersive spectroscopy (EDS) analysis were obtained in the JEOL JEM-2100F (JEOL) microscope. X-ray photoelectron spectroscopy (XPS) data was measured by NEXSA G2 (Thermo Fisher Scientific). X-ray absorption near-edge spectroscopy (XANES) and Extended X-ray absorption fine structure (EXAFS) were performed at Pohang Accelerator Laboratory (PAL) 8C beamline.

Electrochemical Characterization

The electrocatalytic performance for the oxygen reduction reaction (ORR) was evaluated using a rotating disk electrode (RDE, Pine Instrument) system within a three-electrode setup. The counter electrode and reference electrode employed were a glassy carbon rod and Ag/AgCl electrode, respectively. The working electrode was a 5 mm (0.19625 $cm^2$) glassy carbon disk electrode. All potentials are reported relative to the reversible hydrogen electrode (RHE), determined by measuring the equilibrium potential of hydrogen oxidation/evolution under $H_2$-saturated electrolyte using a Pt electrode. The catalyst ink was prepared by mixing the catalyst with Nafion ionomer (5 wt %, Ion Power) and 2-isopropanol (Sigma-Aldrich). The catalyst loading of the Fe—N—C catalyst was 0.2 mg $cm^{-2}$, while that of the commercial 40 wt % Pt/C catalyst (Johnson Matthey) was 0.05 mg $cm^{-2}$, respectively. ORR activity was measured using linear scan voltammetry at a rotation speed of 1600 rpm, a scan rate of 10 mV $s^{-1}$, in an $O_2$-saturated 0.1 M KOH electrolyte. The capacitance arising from non-Faradaic effects was compensated for by measurements conducted under Ar-saturated conditions, and iR-correction was applied.

Electrode Preparation

A titanium felt (Fuel cell store) was first cleaned using acetone and then etched in a boiling 10% oxalic acid (98%, Sigma-Aldrich) solution for half an hour to serve as the electrode substrate. To fabricate RuSnOx-coated Ti felt, a painting solution with a Ru:Sn molar ratio of 50:50 was created by dissolving ruthenium (III) chloride hydrate (99.9%, Sigma-Aldrich) and tin (II) chloride hydrate (98%, Sigma-Aldrich) in isopropanol. This solution was applied to the pre-treated titanium substrate using an airbrush. Subsequently, the coated samples were dried at 100° C. for 10 minutes in an oven and then sintered at 450° C. for 1 hour in a furnace.

Rotating Ring-Disk Electrode Experiment

The rotating ring-disk electrode (RRDE) setup was used to differentiate the current densities for the oxygen evolution reaction and the chloride oxidation reaction. In order to quantify chloride oxidation rates during the electrolysis process, an RRDE setup featuring a platinum ring electrode and a glassy carbon disk electrode was utilized. The potential of Pt ring electrode was fixed at 0.95 V, which enabled the accurate quantification of active chlorine species at the ring through their reduction back to $Cl^-$. The collection efficiency for these active chlorine species was denoted as $N_I$, which was determined by the electrode area. Based on these parameters, the partial current density for chloride oxidation was subsequently calculated by $i_{CER}=i_{Ring}/N_I$. In a typical RRDE test, 5 mg of catalyst was added to 1 ml of isopropyl alcohol and 20 μl of Nafion ionomer (5%; Fuel cell store) and sonicated for 1 h to obtain a well-dispersed catalyst ink. For electrode preparation, 16 μl of catalyst ink was drop-cast onto the glassy carbon disk electrode, resulting in a catalyst loading of 0.4 mg $cm^{-2}$, and then dried at room temperature before usage. A graphite electrode and an Ag/AgCl electrode were used as the counter and reference electrode, respectively. The rotation rate was set to 2,500 r.p.m.

Ethylene Partial Oxidation Experiment

The ethylene partial oxidation was tested using a membrane electrode assembly-based electrolyzer with an active area of 1 $cm^2$. The cell incorporated a ruthenium-based mixed oxide as anodic catalyst. A reinforced cation-exchange membrane from Dongyue was used to separate the cathodic and anodic chamber. The lab-synthesized iron-single atom catalyst or 40% Pt on Vulcan XC72 (Fuel cell store) were used as catalysts for oxygen reduction reaction and carbon capture. 1 M NaCl was fed as the electrolyte on both sides. Various concentrations of $CO_2$ were fed to the cathodic gas chamber with 20% oxygen and nitrogen was used as balanced gas. Ethylene was fed to the anodic gas chamber for ethylene partial oxidation. A constant volume (25 ml) of catholyte and anolyte were circulated through the electrolyzer at a stable flow rate of 10 ml $min^{-1}$ controlled by two peristaltic pumps. The capture efficiency was measured in the flue gas of cathodic chamber by GC injection. After one hour of electrolysis, the anolyte samples were collected to measure the ethylene chlorohydrin formation. Then the anolyte was mixed with catholyte, to measure the ethylene glycol formation and $CO_2$ regeneration. Liquid products were analyzed by NMR spectrometry using DMSO as internal standard via a pre-saturated water suppression method. A typical procedure to prepare an NMR sample was to add 0.1 ml 0.008 M DMSO in $D_2O$ standard and 0.4 ml $D_2O$ to 0.1 ml liquid sample.

In-Situ Photoluminescence Study

To evaluate the local pH at the interface of the catalyst and the membrane in the membrane electrode assembly, a pH-sensitive dye, LysoSensor Green DND 189 (LSG), was affixed to the membrane and an in-situ photoluminescence study was executed. UV light at 365 nm was used to collect fluorescence emissions via a spectrometer (Ocean Optics, QE Pro). The dyes were calibrated using solutions of varying pH levels (1-7) to determine their fluorescence, with 100 μM of the dyes dissolved in the solutions. LSG demonstrated fluorescence emission between 500 nm and 575 nm at a pH range of 1-6. Consequently, alterations in pH at the membrane interface can be examined by monitoring the peak shifts of the pH-sensitive dyes.

In-Situ Kinetics NMR Measurement

The in-situ kinetics NMR study was carried out using a 400 MHz Bruker Avance III HD Nanobay system. The ethylene chlorohydrin obtained from the electrochemical chloride-mediated ethylene partial oxidation was collected, which was then subjected to alkaline and neutral conditions by introducing stoichiometric amounts of sodium hydroxide and sodium bicarbonate. Post-electrolysis ethylene chlorohydrin solution with a pH of 1.5 was used for the control experiment. Dimethyl sulfoxide in deuterium water was used as internal standard. The one-dimensional 1H spectrum was acquired every two minutes to monitor the hydrolysis of ethylene chlorohydrin employing water suppression via a pre-saturation method.

Density Functional Theory (DFT) Calculations

In this Example, all DFT calculations were performed with periodic slab models using the Vienna ab initio simulation package (VASP). The Perdew-Burke-Ernzerhof (PBE) exchange-correlation functional was used. The projector-augmented wave (PAW) method was utilized to describe the electron-ion interactions, and the cut-off energy for the plane-wave basis set was 520 eV. All the configurations were optimized using a force-based conjugate gradient algorithm. The D3 correction method was used to correct the long-range dispersion interactions between the adsorbates and catalysts. Dipole correction was also considered to correct the electrostatic interaction resulted from the periodic images.

Figure 1A:
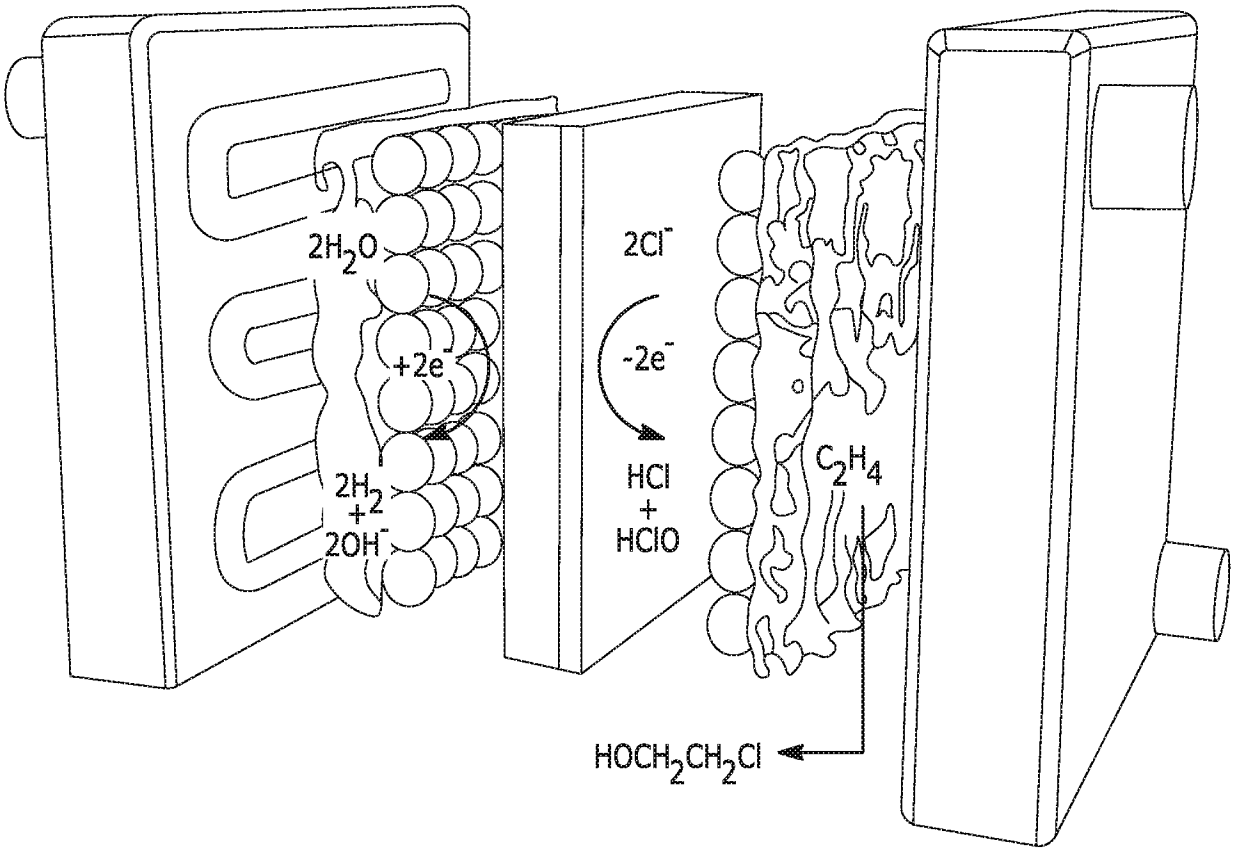
FIGS. 1A-1E demonstrate the local microenvironment impact on the electrochemical ethylene partial oxidation.
Figure 1B:
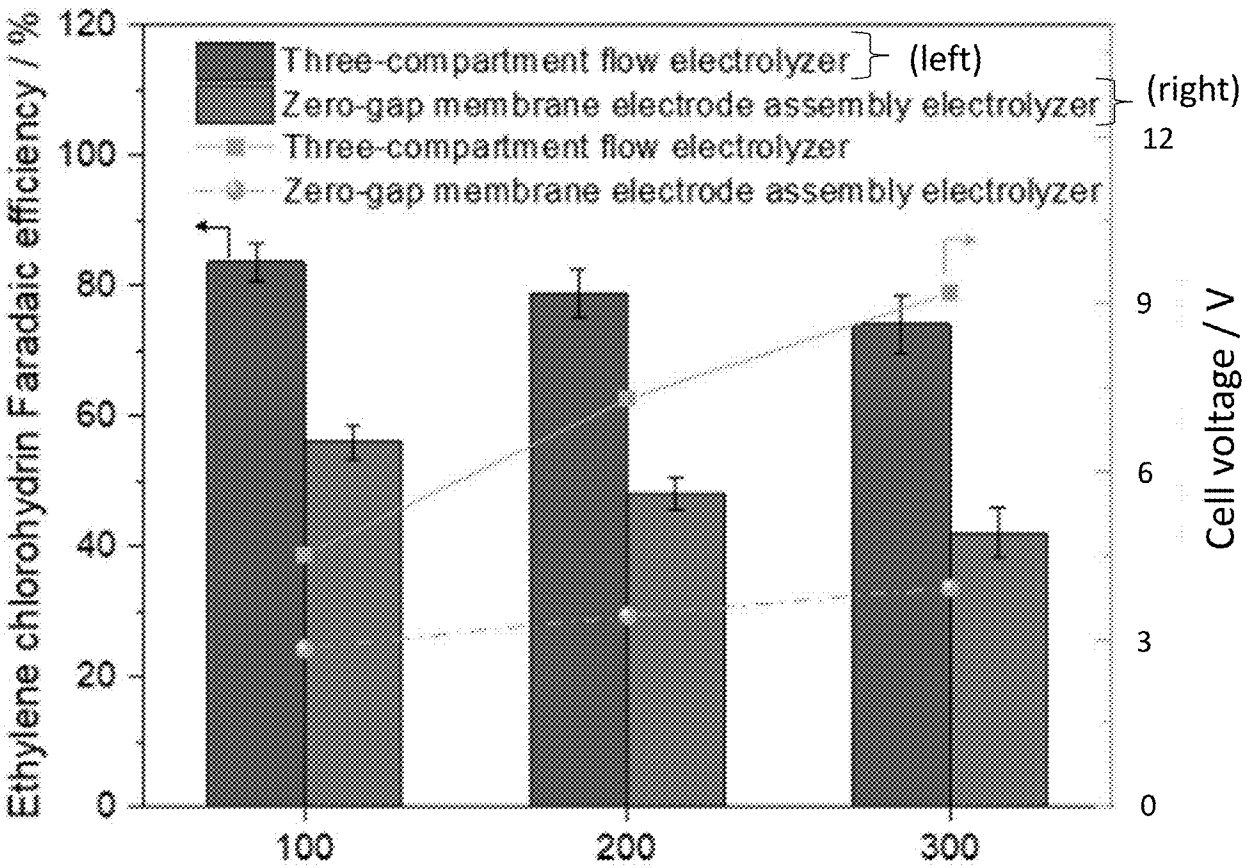

Ethylene partial oxidation was conducted via a chloride-mediated mechanism in which ethylene is converted to ethylene chlorohydrin facilitated by hypochlorous acid from anodic chloride oxidation (see FIG. 1A). Conventionally, this reaction has been realized in a three-compartment flow electrolyzer, which, despite its product selectivity, was constrained by a high full cell voltage. By contrast, in this Example, a zero-gap membrane-electrode assembly (MEA) configuration was used, which mitigates internal ohmic resistances and reduces the full cell voltage. Using $RuO_2$ as an anodic catalyst, the zero-gap MEA electrolyzer demonstrated a full cell voltage of 2.7 V at 100 mA cm 2, marking a significant reduction from the 4.5 V observed in the conventional three-compartment electrolyzer (FIG. 1B). However, a Faradaic efficiency of only 42% towards ethylene chlorohydrin in the MEA configuration was found. This discrepancy implied changes in local microenvironments and shifts in the electrochemical surface reaction dynamics existed.

In the zero-gap setup, the anode is in direct contact with the membrane, while the three-compartment configuration positions a 5 mm gap in between. After applying 100 mA $cm^{-2}$ for 30 minutes, a stark pH gradient across the membrane was observed, with the anolyte at pH 1.5 and the catholyte at pH 11.7. To determine the local pH at the catalyst-membrane interface in the membrane electrode assembly, a pH-sensitive dye, LysoSensor Green DND 189 (LSG), was anchored onto the membrane and an in-situ photoluminescence study was conducted. Results indicated a near-neutral pH of 5-6 on the surface of the membrane facing anode, contrasting with the anolyte bulk pH of 1.49 (data not shown). This was determined to be due to the undesired back-migration of hydroxide ions stemming from the extensive pH gradient.

Figure 1C:
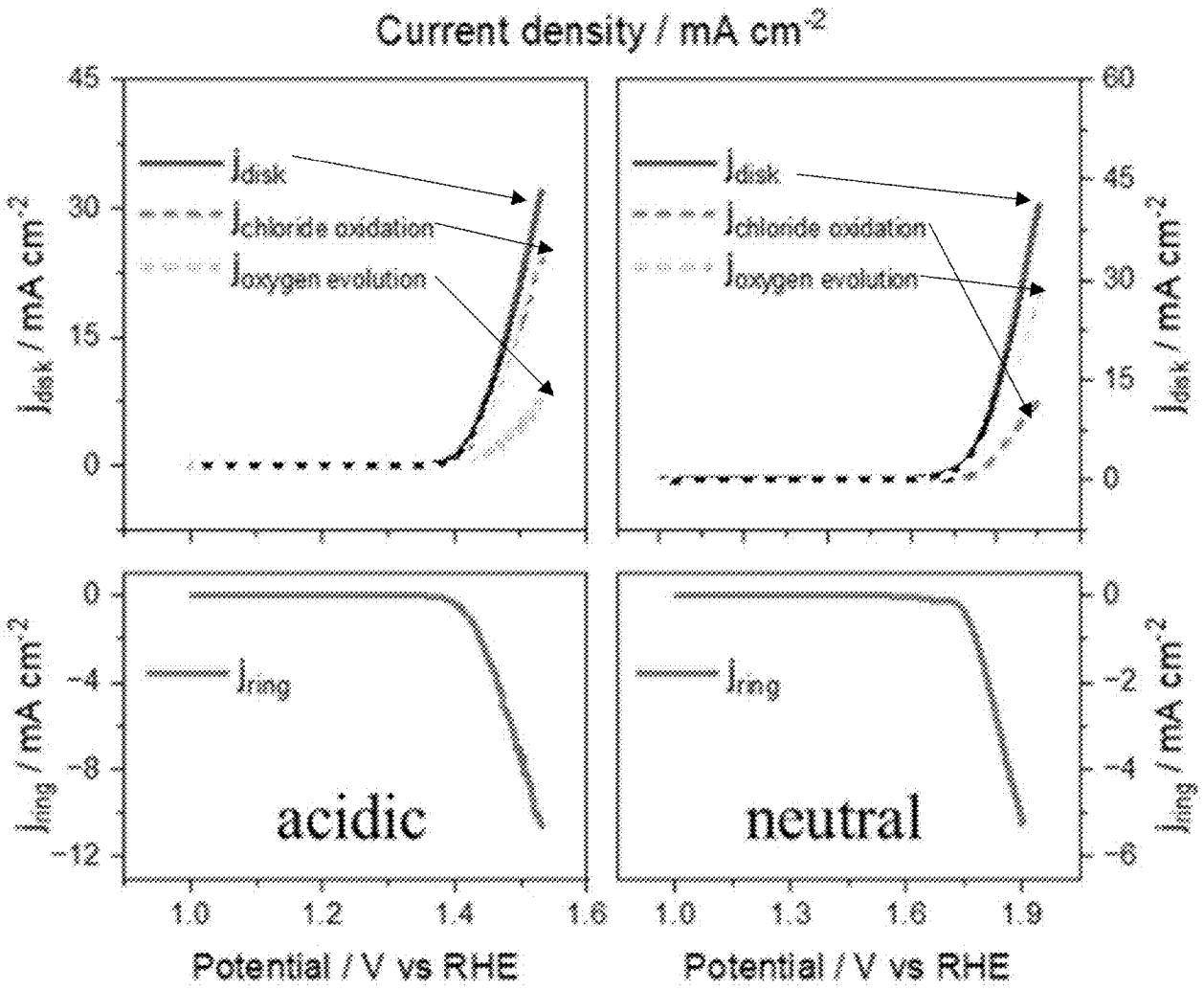

The local pH affects the ethylene partial oxidation by altering the thermodynamics of chloride oxidation and oxygen evolution. The equilibrium potentials are 1.229 V vs. RHE for oxygen evolution and 1.358+0.059 pH V vs. RHE for chloride oxidation. Meanwhile, chloride oxidation involves only two electron transfers and has a more favorable kinetics than oxygen evolution reaction. Thus, acidic environments favor chloride evolution, while neutral conditions favor oxygen evolution. This was validated by the Rotating Ring-Disk Electrode (RRDE) measurements (FIG. 1C). Employing $RuO_2$ under acidic conditions, a dominance of chloride oxidation was observed. However, the bias transitioned towards oxygen evolution as the pH approached neutrality. Combined with the in-situ photoluminescence study, these findings show that the compromised selectivity observed in membrane electrode assembly (MEA)-based electrolyzer for ethylene partial oxidation was attributable to changes in the microenvironment.

The inventors had the insight that coupling $CO_2$ capture with ethylene oxidation, instead of hydrogen evolution, could benefit the overall device efficiency by regulating the anodic microenvironment for ethylene partial oxidation. Specifically, coupling $CO_2$ capture at the cathode could capitalize on the $OH^-$ generated at the gas diffusion interface (convert to (bi) carbonate), mitigate the overpotential induced by pH gradient, and suppress the hydroxide back-migration.

Figure 1E:
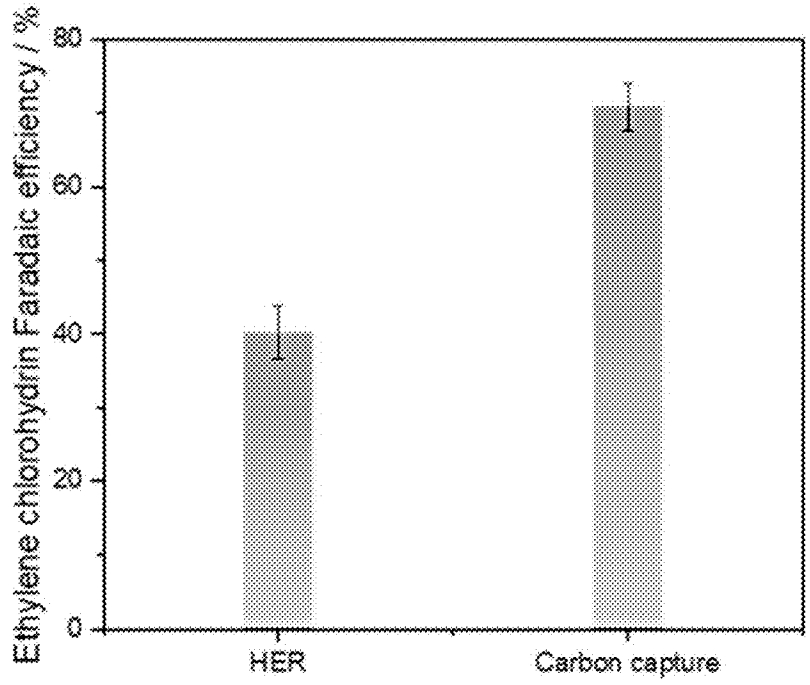
Figure 1D:
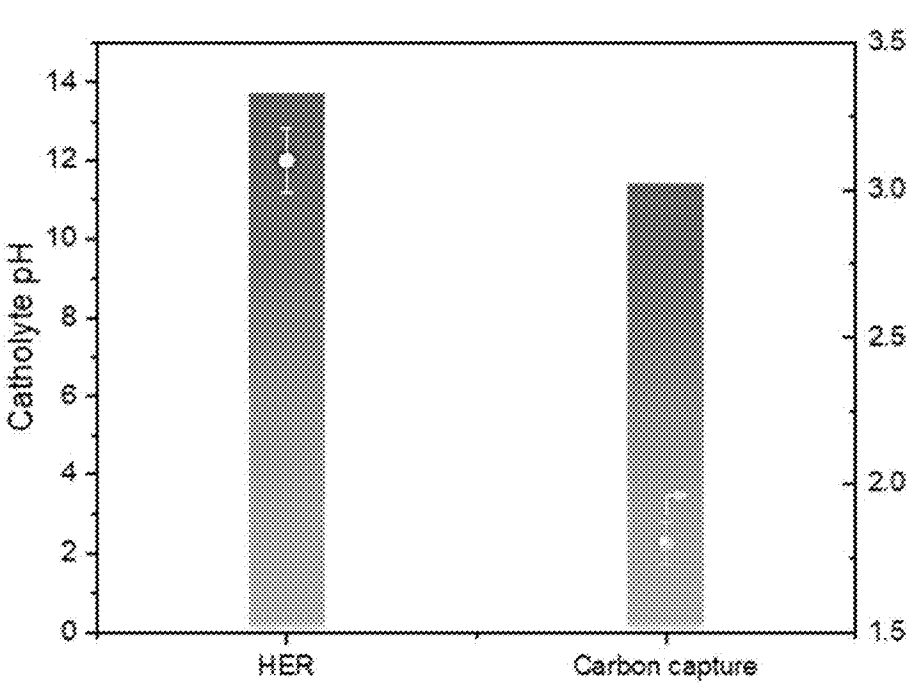

Iron-single-atom catalysts (denoted as Fe—N—C) were used as cathodic catalysts. Notably, the Fe—N—C catalysts exhibit a $CO_2$ capture efficiency of 92.7% in a feeding stream composed of 10% $CO_2$, 20% $O_2$, and 70% $N_2$, with an overpotential comparable to commercial 40 wt % Pt/C. Gas chromatography and NMR analysis revealed no detectable byproducts, indicating the absence of competing reactions, such as hydrogen evolution or $CO_2$ electroreduction. The $CO_2$ capture-ethylene oxidation device displayed a substantial two-unit decrease in the catholyte's pH and a reduction in the full cell voltage by 1.3 V. (See FIG. 1D.) Concomitantly, the Faradaic efficiency for anodic ethylene partial oxidation increased from 40.2% to 70.9%, underscoring the efficacy of tempering the pH gradient at the membrane interface for promoting the ethylene partial oxidation. (See FIG. 1E.)

Figure 2B:
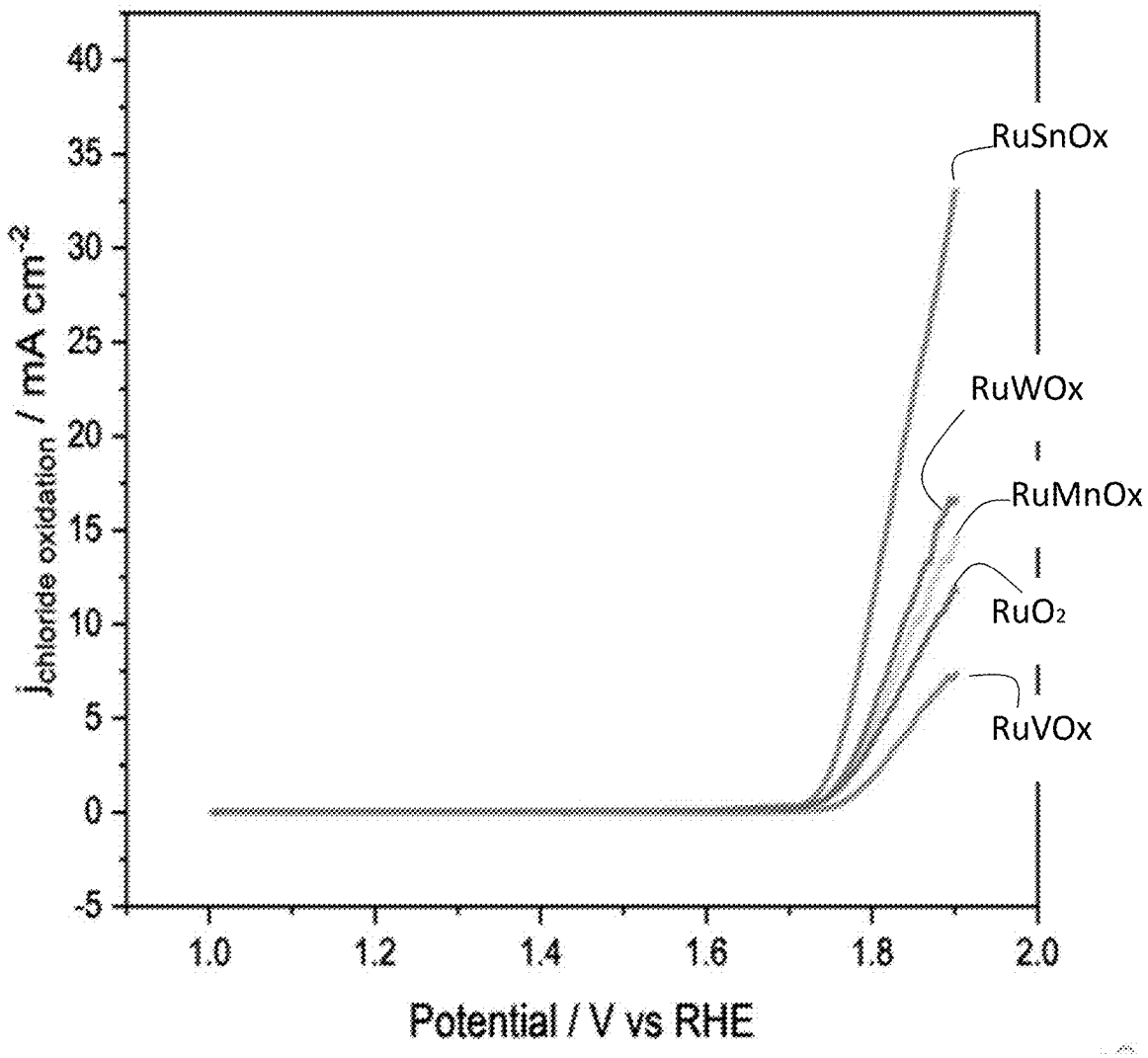
Figure 2C:
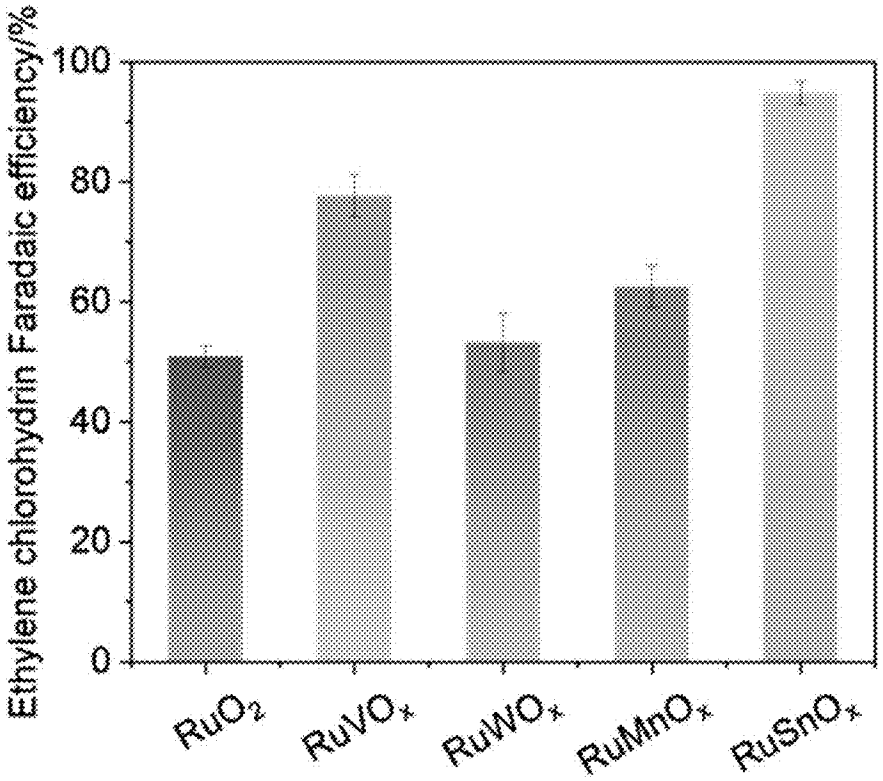
Figure 2D:
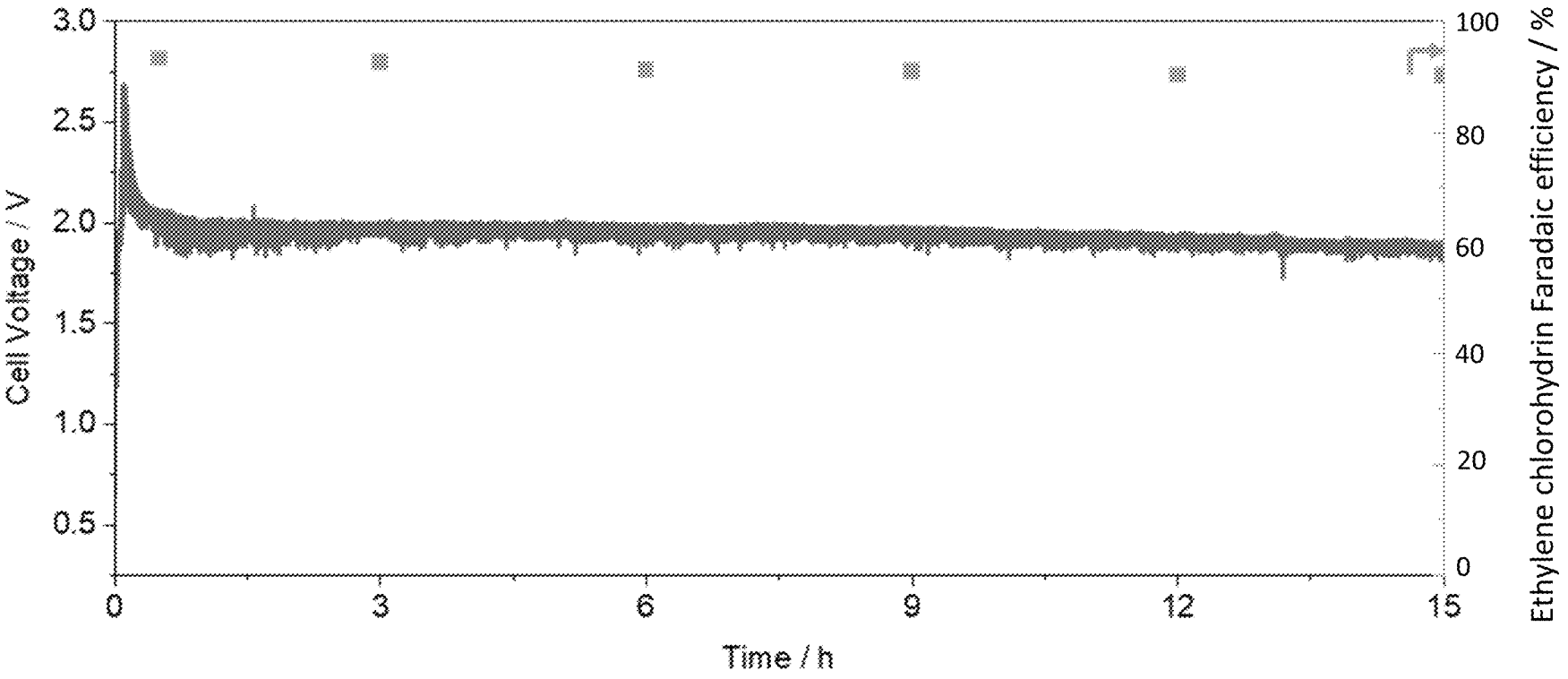

To further enhance the selectivity of ethylene partial oxidation, a secondary transition metal was introduced into $RuO_2$ to form mixed oxide catalysts. The transition metals, tin, vanadium, magnesium, and tungsten, were selected based on their ionic radii, closely matching that of $Ru^{4+}$. This resemblance facilitated their incorporation into the $RuO_2$ rutile crystal lattices to form a solid solution, according to the Hume-Rothery rule. Moreover, incorporating a "valve metal" can stabilize the ruthenium cation within the tetragonal rutile crystal structure, significantly enhancing stability in acidic oxygen evolution reactions. A series of $RuMO_x$ (M=V, W, Mn, Sn) catalysts were synthesized using a hydrothermal method. Characterization using X-ray photoelectron spectroscopy (XPS) (FIG. 2A) and Scanning electron microscopy/energy dispersive X-ray spectroscopy (SEM-EDS) (data not shown) confirmed the homogeneous dispersion of ruthenium and the secondary transition metal within the mixed oxide catalysts. Preliminary tests of these catalysts using an RRDE setup, focused on chloride oxidation activity, revealed that $RuSnO_x$ exhibited the highest chloride oxidation partial current density among all catalysts (FIG. 2B). Further evaluation in a membrane-electrode assembly configuration demonstrated that $RuSnO_x$ achieved the top Faradaic efficiency (up to 94%) towards ethylene chlorohydrin (FIG. 2C), in line with the RRDE findings. Notably, $CO_2$ was not detected in the gas product, indicating overoxidation was successfully circumvented in chloride-mediated ethylene partial oxidation. The stability of $RuSnO_x$ catalysts was evaluated at a constant current density of 100 mA $cm^{-2}$ over 15 hours, during which the cell voltage and Faradaic efficiency toward ethylene chlorohydrin remained stable (FIG. 2D).

To elucidate how Sn doping improves the thermodynamic stability and catalytic activity of $RuO_2$, Density Functional Theory (DFT) calculations were first used to generate a bulk Pourbaix diagram (not shown). The reaction conditions (pH=5 and U=1.71 V) were set based on findings from in-situ photoluminescence and RRDE experiments. Under these conditions, the Pourbaix energy of $RuO_2$ ($\Delta G_{pbx}$ ($RuO_2$)) was determined to be 1.30 eV. This value indicates that the energy of $RuO_2$ was 1.30 eV higher than the thermodynamically stable species $RuO_4$. Simultaneously, under the same conditions, $\Delta G_{pbx}$ ($RuSnO_x$) was calculated to be 0.80 eV, indicating the energy of $RuSnO_x$ was only 0.80 eV above the thermodynamically stable species $RuO_4$+$SnO_2$. Therefore, the lower $\Delta G_{pbx}$ value of $RuSnO_x$ signifies its enhanced thermodynamic stability compared to $RuO_2$ under chloride oxidation conditions. DFT calculations were further performed to compare the chloride oxidation energetics on the (110) surfaces of both $RuO_2$ and $RuSnO_x$ with a $10Cl_c1O_c$ termination, using the two-step Volmer-Heyrovsky mechanism (data not shown). From these, the overpotentials of $RuO_2$ and $RuSnO_x$ were calculated to be 0.16 V and 0.09 V, respectively. These results indicated the catalytic activity of $RuSnO_x$ was enhanced by incorporating Sn into the $RuO_2$ structure.

Figure 3B:
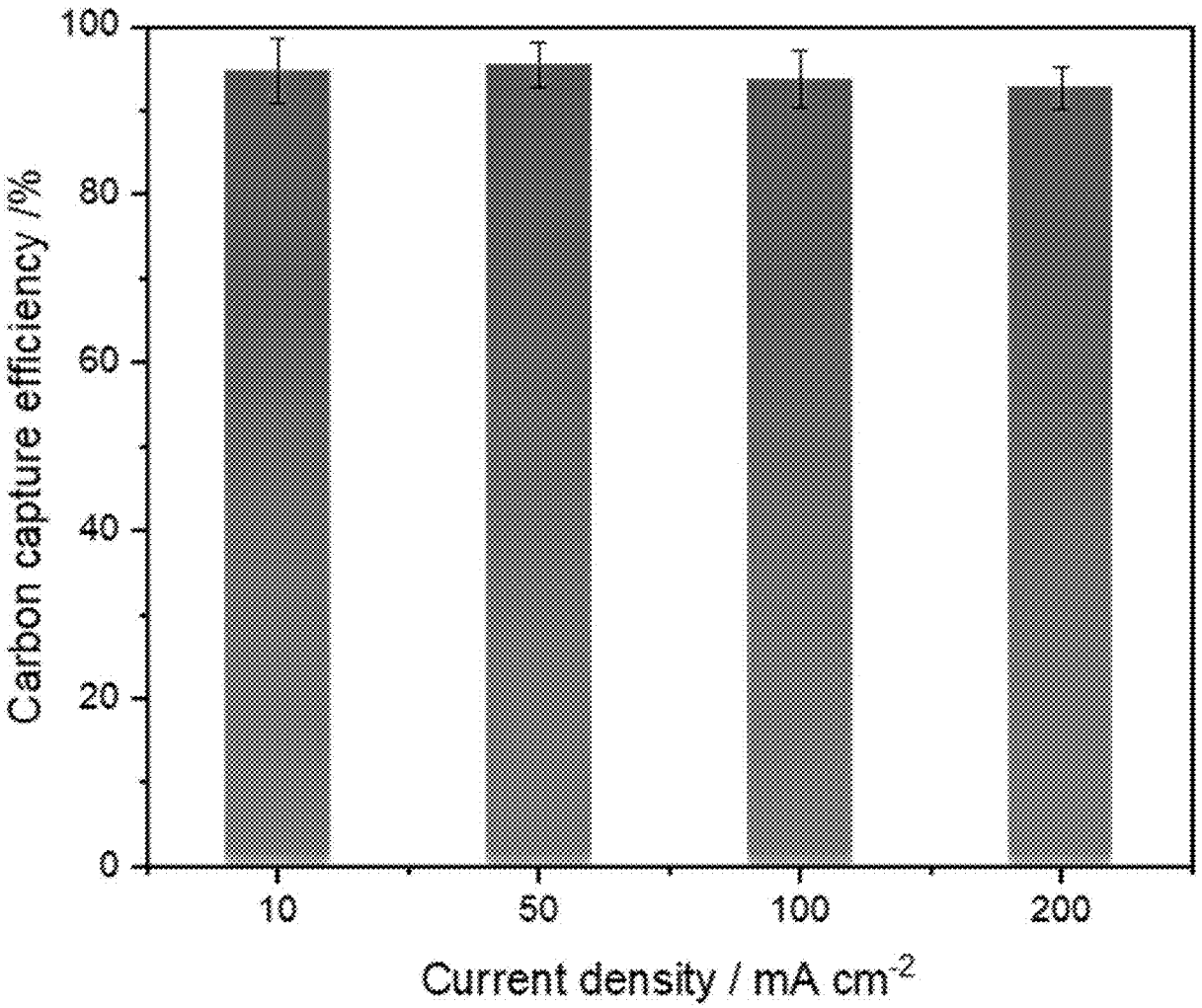
Figure 3C:
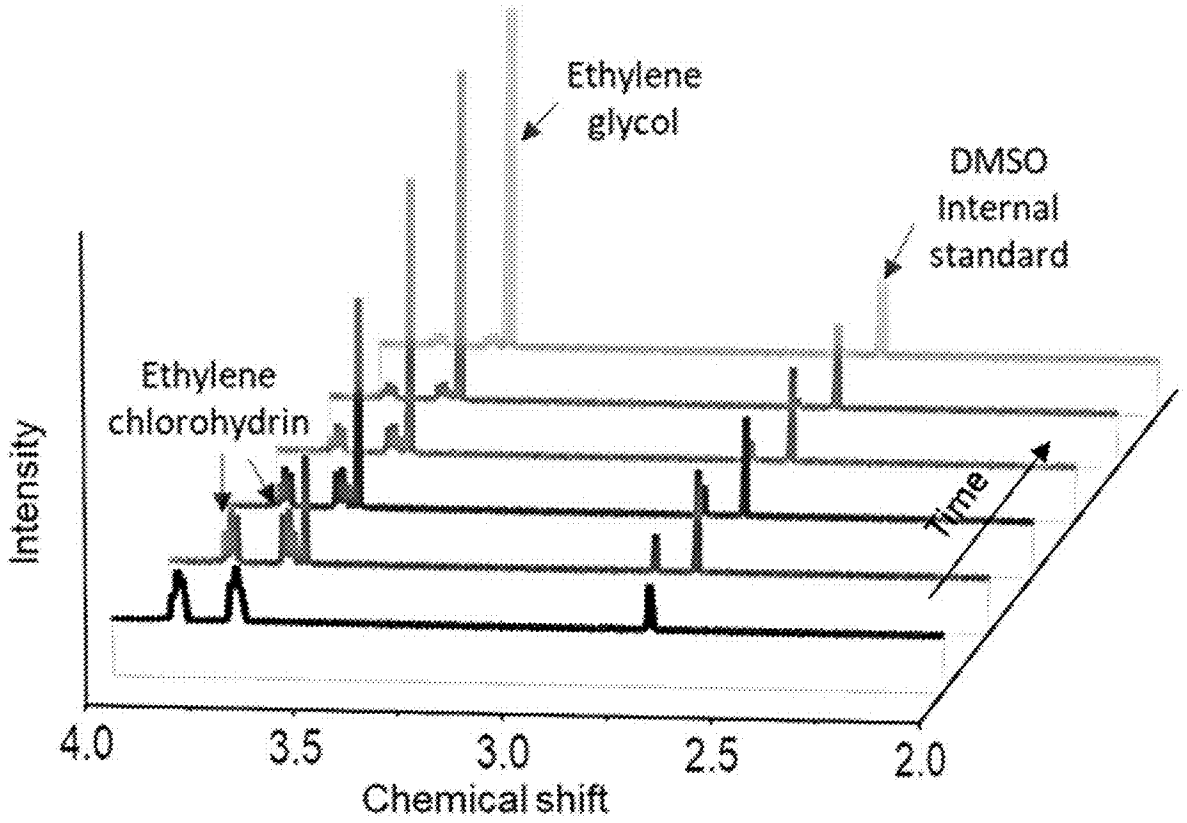
Figure 3D:
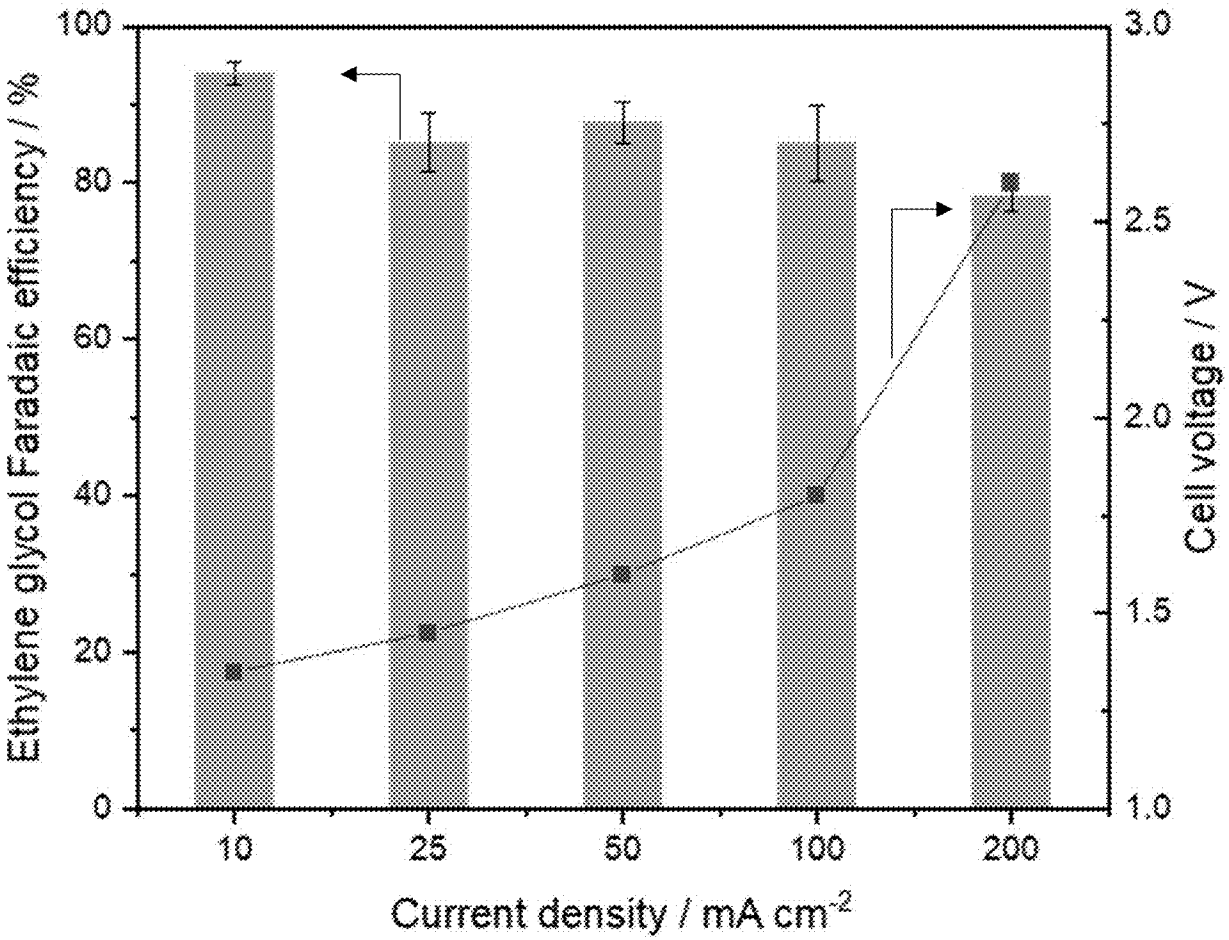
Figure 3E:
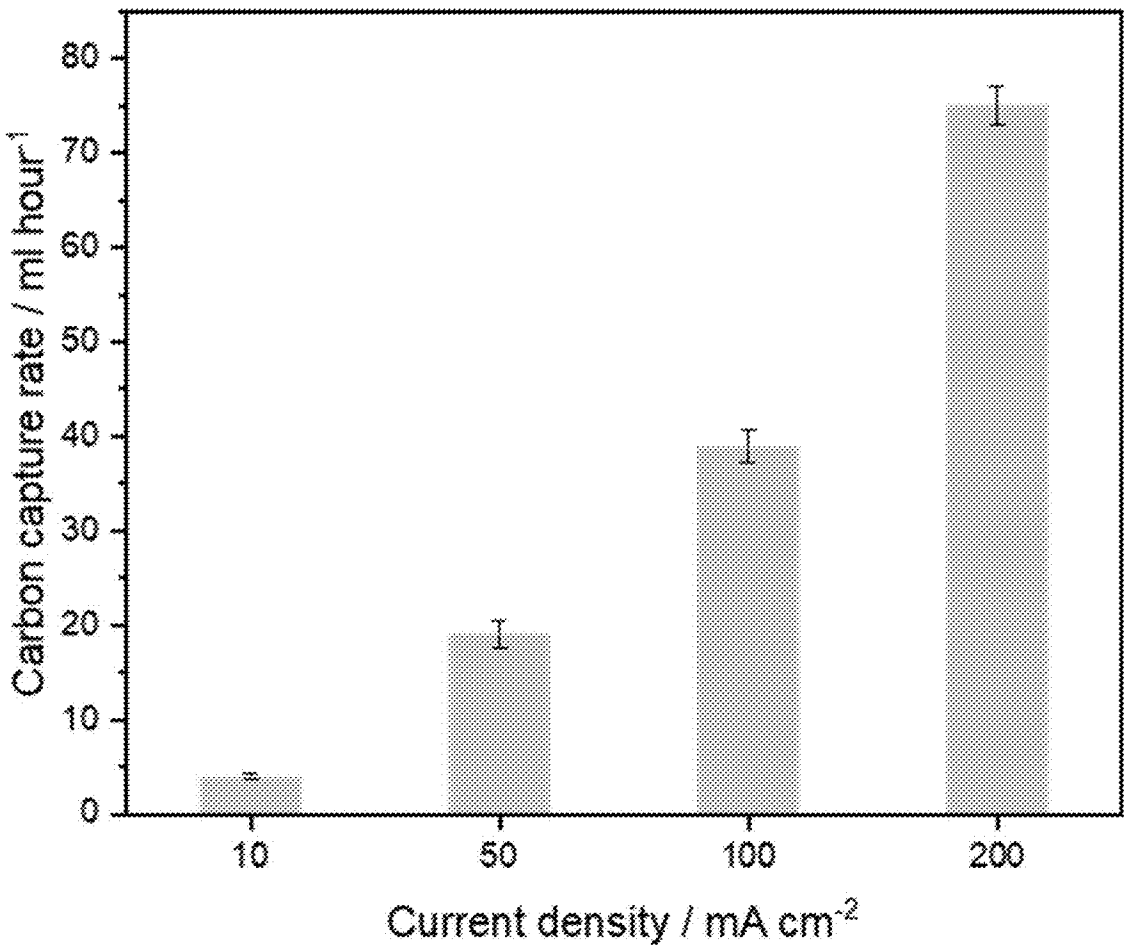

FIG. 3A illustrates the integrated system used that couples ethylene partial oxidation (leveraging $RuSnO_x$) with carbon capture (using Fe—N—C single-atom catalysts). At a full cell voltage of 1.8 V and a current density of 100 mA $cm^{-2}$, the system consistently achieved carbon capture efficiencies ranging from 91.3% to 95.5% for $CO_2$ concentrations between 1-10% in a feeding gas composed of 20% $O_2$ and 70-79% $N_2$ (see FIG. 3B). The anodic side exhibited up to 94% Faradaic efficiency in producing ethylene chlorohydrin. Notably, when the carbon capture catholyte was added to the anolyte outside the electrolyzer, it triggered the hydrolysis of ethylene chlorohydrin to ethylene glycol as illustrated by the in-situ kinetics NMR study (FIG. 3B). Regarding the mechanism of ethylene chlorohydrin hydrolysis, under alkaline conditions, hydrolysis primarily produced ethylene oxide, while neutral pH favored ethylene glycol. Intriguingly, no hydrolysis was detected under acidic conditions. This phenomenon can be attributed to the fact that an alkaline environment facilitates the formation of the 2-chloroethoxide ion, as described by the equation $[^{-}CH_2CH_2Cl]=K_H[HO^{-}][HOCH_2CH_2Cl]/[H_2O]$, which subsequently undergoes ring closure to produce ethylene oxide. In contrast, under neutral conditions, the formation of the 2-chloroethoxide ion is suppressed, promoting the direct hydrolysis of ethylene chlorohydrin to ethylene glycol. The transformation of ethylene chlorohydrin to ethylene glycol was accompanied by the concurrent regeneration of $CO_2$ and sodium chloride. Ethylene glycol was produced at a rate of 175-1586 μmol $h^{-1}$ $cm^{-2}$ under various current densities, corresponding to a Faradaic efficiency of 85.1-94.0% (FIG. 3D), while $CO_2$ was regenerated at a rate of 4.0-75.0 ml $h^{-1}$ $cm^{-2}$ (FIG. 3E). Subsequent post-reaction analysis indicated that over 95.0% of ethylene chlorohydrin and sodium carbonate were converted into ethylene glycol and $CO_2$. No active chlorine species were detected in the liquid product or regenerated $CO_2$ stream. Extending the hydrolysis duration elevated the conversion rate to 99.2%.

This Example reveals that the present integrated system offers a significant advantage over traditional methodologies. Specifically, the system can sequester 0.75 tonnes of $CO_2$ for every tonne of ethylene glycol produced while requiring only 6.9 GJ of energy. Conventional ethylene glycol production and carbon capture consume 20.0 GJ/tonne of ethylene glycol and 3.5 GJ/tonne of $CO_2$. Consequently, conventional methods require 22.6 GJ for comparable results. (See FIG. 4A). A cradle-to-grave life cycle assessment further highlights the environmental advantages of the present carbon-negative ethylene glycol electrosynthesis approach. Conventional ethylene glycol production emits 1.25 tonnes of $CO_2$ eq per tonne—0.84 tonnes from oil cracking and 0.41 tonnes from ethylene oxidation (FIG. 4B). The carbon-negative ethylene glycol electrosynthesis approach with ethylene from oil cracking reduces the carbon footprint to just 0.11 tonnes of $CO_2$ eq per tonne, representing a tenfold decrease. When implementing electrochemical $CO_2$ reduction for ethylene production, the integrated approach further reduces the carbon footprint to −2.06 tonnes of $CO_2$ eq. Compared to conventional coal-to-ethylene glycol, methanol-to-ethylene glycol, and ethylene-to-ethylene glycol pathways, which emit between 1.25 to 4.67 tonnes of $CO_2$ eq, the present strategy clearly emerges as a significant step towards the decarbonization of the ethylene industry (FIG. 4C). The techno-economic analysis further confirms the economic viability of our integrated system, driven by high market demand for ethylene glycol and outstanding system efficiency (>90% Faradaic efficiency and <1.85 V cell voltage). Overall, the present integrated approach offers an innovative, energy-saving solution with the potential to revolutionize traditional processes, significantly reducing both energy consumption and carbon emissions.

Additional information, including additional experimental data and figures is found in U.S. provisional patent application No. 63/607,143 that was filed Dec. 7, 2023, the entire contents of which are incorporated herein by reference.

Example 2

Methods

Synthesis of Fe—N—C Catalyst

In a typical synthesis of N-doped carbon, a 400 mL methanol solution containing 9.04 g of $Zn(NO_3)_2 \cdot 6H_2O$ was poured into another 400 mL methanol solution containing 10.507 g of 2-methylimidazole, while stirring quickly. The mixture was stirred for 2 minutes and then kept in a stable condition for 1 day without further stirring. Afterward, the white precipitates were collected by centrifugation, washed with methanol three times, and dried in a vacuum oven at 70° C. To obtain N-doped carbon, the synthesized zeolitic imidazolate framework (ZIF-8) powders were ground and then subjected to heat treatment at 900° C. for 1 hour under Ar purging conditions in a tube furnace. Subsequently, we dispersed 200 mg of N-doped carbon in 40 mL of $H_2O$ and sonicated it for 20 minutes. Then, 1 mL of $Fe(NO_3)_3$ solution (prepared by dissolving 269.3 mg of iron nitrate in 10 mL of $H_2O$) was added to the dispersion and subjected to an additional 20 minutes of sonication, followed by continuous stirring for 24 hours. After filtration, the resulting precipitate was rinsed with deionized water and dried in a vacuum oven overnight. In the final step, the dried sample was pyrolyzed in the tube furnace at 1000° C. for 2 hours under an Ar atmosphere.

Materials Characterization

Morphological characterization of the synthesized sample was performed by using Transmission electron microscopy (TEM, JEOL JEM-2100F) at an acceleration voltage of 200 kV. High-angle annular dark field-scanning TEM (HAADF-STEM) and energy dispersive spectroscopy (EDS) analysis were obtained in the JEOL JEM-2100F (JEOL) microscope. X-ray photoelectron spectroscopy (XPS) data was measured by NEXSA G2 (Thermo Fisher Scientific). X-ray absorption near-edge spectroscopy (XANES) and Extended X-ray absorption fine structure (EXAFS) were performed at the Pohang Accelerator Laboratory (PAL) 8C beamline.

Electrochemical Characterization

The electrocatalytic performance for the oxygen reduction reaction (ORR) was evaluated using a rotating disk electrode (RDE, Pine Instrument) system within a three-electrode setup. The counter electrode and reference electrode employed were a glassy carbon rod and an Ag/AgCl electrode, respectively. The working electrode was a 5 mm (0.19625 $cm^2$) glassy carbon disk electrode. All potentials are reported relative to the reversible hydrogen electrode (RHE), determined by measuring the equilibrium potential of hydrogen oxidation/evolution under an $H_2$-saturated electrolyte using a Pt electrode. ORR activity was measured using linear scan voltammetry at a rotation speed of 1600 rpm, and a scan rate of 10 mV $s^{-1}$, in an $O_2$-saturated 0.1 M KOH electrolyte. The capacitance arising from non-Faradaic effects was compensated for by measurements conducted under Ar-saturated conditions, and iR-correction was applied.

Electrode Preparation

To fabricate $RuSnO_x$-coated Ti electrode, titanium felt is treated in 0.5 M oxalic acid (98%, Sigma-Aldrich) at 80° C. for 30 minutes and washed by DI water and dry in the vacuum oven. A painting solution of 0.02 mM ruthenium chloride hydrate (99.9%, Sigma-Aldrich) and 0.02 mM tin chloride hydrate (98%, Sigma-Aldrich) in isopropanol was prepared with a Ru:Sn molar ratio of 1:1. This solution was applied to the pre-treated titanium substrate using an air-brush with a loading of 2 mg $cm^{-2}$. The loading is determined by measuring the mass difference. Subsequently, the coated samples were dried at 100° C. for 10 minutes in an oven and then sintered at 450° C. for 1 hour in a furnace. For cathode, the catalyst ink was prepared by mixing the catalyst with Nafion ionomer (5 wt %, Ion Power) and isopropanol (Sigma-Aldrich). The catalyst loading of the Fe—N—C catalyst was 2 mg $cm^{-2}$. The catalysts were sprayed onto Ag-sputtered porous PTFE membrane using a spray gun as a gas diffusion electrode. Ag/PTFE gas diffusion layer was prepared by sputtering a 300 nm thick Ag layer onto a PTFE membrane (average pore size of 450 nm) using an Ag target (99.99%) at a rate of 1 Å $s^{-1}$.

Rotating Ring-Disk Electrode Experiment

The rotating ring-disk electrode (RRDE) setup is used to differentiate the current densities for the oxygen evolution reaction and the chloride oxidation reaction. In order to quantify chloride oxidation rates during the electrolysis process, we utilize an RRDE setup featuring a platinum ring electrode and a glassy carbon disk electrode. The potential of the Pt ring electrode is fixed at 0.95 V, which enables the accurate quantification of active chlorine species at the ring through their reduction back to $Cl^-$. The collection efficiency for these active chlorine species is denoted as $N_I$, which is determined by the electrode area. Based on these parameters, the partial current density for chloride oxidation can subsequently be calculated by $$i_{CER} = \frac{i_{Ring}}{N_I}.$$

In a typical RRDE test, 5 mg of catalyst was added to 1 ml of isopropyl alcohol and 20 μl of Nafion ionomer (5%; Fuel cell store) and sonicated for 1 h to obtain a well-dispersed catalyst ink. For electrode preparation, 16 μl of catalyst ink was drop-cast onto the glassy carbon disk electrode, resulting in a catalyst loading of 0.4 mg cm 2, and then dried at room temperature before usage. A graphite electrode and an Ag/AgCl electrode were used as the counter and reference electrode, respectively. The rotation rate is set to 2500 r.p.m.

Ethylene Partial Oxidation Coupled with Carbon Capture

The ethylene partial oxidation was first tested using a MEA-based electrolyzer with an active area of 1 $cm^2$. The cell incorporated a ruthenium-based mixed oxide as the anodic catalyst. A reinforced cation-exchange membrane (DF2807, Dongyue Polymer Material., Ltd.) was used to separate the cathodic and anodic chambers. The lab-synthesized iron-single atom catalysts or 40% Pt on Vulcan XC72 (Fuel cell store) were used as catalysts for oxygen reduction reaction and carbon capture. 1 M NaCl is fed as an electrolyte on both sides. After switching to the ethylene oxidation paired with carbon capture, the anode remains in direct contact with the membrane, while a 2 mm microfluidic channel (Supplementary FIG. 32) was introduced between cathode and membrane to remove the carbonate and prevent salt precipitation. Various concentrations of $CO_2$ are fed to the cathodic gas chamber with 20% oxygen and nitrogen is used as the balanced gas. Ethylene is fed to the anodic gas chamber for ethylene partial oxidation. A constant volume (25 ml) of catholyte and anolyte was circulated through the electrolyzer at a stable flow rate of 10 ml $min^{-1}$ controlled by two peristaltic pumps. The $CO_2$ capture efficiency is defined as the ratio of {the number of $OH^-$ that convert $CO_2$ to carbonate} to {the number of cathodically-generated hydroxide ions}. The amount of captured $CO_2$ was determined by subtracting the $CO_2$ measured in the outlet of the cathodic chamber (via GC injection) from the $CO_2$ fed into the electrolyzer. The number of cathodically-generated hydroxide ions was calculated by the current density. After the experiment, the anolyte samples were collected to measure the ethylene chlorohydrin formation. Then the anolyte was mixed with catholyte, to measure the ethylene glycol formation and $CO_2$ regeneration. The regenerated $CO_2$ was measured using a water displacement method. Liquid products were analyzed by NMR spectrometry using DMSO as an internal standard via a pre-saturated water suppression method. A typical procedure to prepare an NMR sample is to add 0.1 ml 0.008 M DMSO in D20 solution and 0.4 ml $D_2O$ to 0.1 ml liquid sample.

In-Situ Photoluminescence Study

To evaluate the local pH at the interface of the catalyst and the membrane in the MEA, we affixed a pH-sensitive dye, LysoSensor Green DND 189 (LSG), to the membrane and executed an in-situ photoluminescence study. We employed UV torch at 385 nm to collect fluorescence emissions via a spectrometer (Ocean Optics, QE Pro). The dyes were calibrated using solutions of varying pH levels (1-7) to determine their fluorescence, with 100 μM of the dyes dissolved in the solutions. And PL spectra of the standards were collected in a cuvette using a spectrometer (Ocean Optics, QE Pro), fiber-coupled UV LED (Ocean Optics), and a cuvette holder (ocean optics). LSG demonstrated fluorescence emission between 500 nm and 575 nm at a pH range of 1-7. Consequently, alterations in pH at the membrane interface can be examined by monitoring the peak shifts of the pH-sensitive dyes.

In-Situ Kinetics NMR Measurement

The in-situ kinetics NMR study is carried out using a 400 MHz Bruker Avance III HD Nanobay system. The ethylene chlorohydrin obtained from the electrochemical chloride-mediated ethylene partial oxidation was collected, which was then subjected to alkaline and neutral conditions by introducing stoichiometric amounts of sodium hydroxide and sodium bicarbonate. We used post-electrolysis ethylene chlorohydrin solution with a pH of 1.5 as our control experiment. Dimethyl sulfoxide in deuterium water is used as an internal standard. The one-dimensional 1H spectrum was acquired every two minutes to monitor the hydrolysis of ethylene chlorohydrin employing water suppression via a pre-saturation method.

Density Functional Theory (DFT) Calculations

In this work, all DFT calculations were performed with periodic slab models using the Vienna ab initio simulation package (VASP). The Perdew-Burke-Ernzerhof (PBE) exchange-correlation functional was used. The projector-augmented wave (PAW) method was utilized to describe the electron-ion interactions, and the cut-off energy for the plane-wave basis set was 520 eV. All the configurations were optimized using a force-based conjugate gradient algorithm. We employed the D3 correction method proposed by Grimme et al. to correct the long-range dispersion interactions between the adsorbates and catalysts. Dipole correction was also considered to correct the electrostatic interaction resulting from the periodic images. The crystal orbital Hamilton population (COHP) analysis was performed using the Lobster 5.1.0 package.

Introduction

In this study, we used in-situ photoluminescence to explore the electrochemical interface in the chloride-mediated ethylene oxidation, and we found the environment to be near-neutral at the membrane/anode interface, as a result of a pronounced pH gradient across the membrane. This observation highlights a trade-off, in this first attempt at implementing a membrane electrode assembly for anodic chloride-mediated ethylene oxidation, between ethylene oxidation FE and internal resistance (this latter contributing to a high full cell voltage). We thus explored using the process of $CO_2$ capture on the cathodic side to consume $OH^-$ and mitigate undesired hydroxide counter-migration. Previous studies used pH gradients for electrochemical carbon capture—often relying on organic redox-active mediators or bipolar membranes. The former is limited to low current densities (<10 mA $cm^{-2}$) and sensitivity to oxygen; while the latter relies on bipolar membranes and solid electrolytes, with the best reported full cell voltage of 1.9 V at 100 mA $cm^{-2}$. The present study instead takes advantage of the pH gradient in ethylene oxidation using a cation-exchange membrane-based microfluidic electrolyzer for carbon capture, and operates at 1.8 V and 100 mA $cm^{-2}$. We further developed tin-doped $RuO_2$ that favors *Cl adsorption over *OH, shifting the selectivity towards chloride-mediated ethylene under near-neutral environment in the paired electrolyzer and achieve a 94% FE for chloride-mediated ethylene oxidation. For cathodic carbon capture, it demonstrates a 91% carbon capture efficiency in a 10% $CO_2$ stream and captures 0.75 tonnes of $CO_2$ per tonne of EG produced. This configuration lowers the total energy consumption of the system to 12.7 GJ/ton EG (with 6.6 GJ attributed to the electrolysis step), compared to 22.6 GJ/ton EG for traditional methods. Meanwhile, this approach offsets the carbon footprint of the fossil fuel-derived ethylene feedstock, leading to an estimated carbon intensity of 0.13 ton$CO_2$ eq/tonEG, compared to the 1.2 ton$CO_2$ eq/tonEG global average for ethylene glycol today.

Results and Discussion

Impact of the Local Microenvironment on Electrochemical Ethylene Partial Oxidation.

In initial studies, we fabricated a zero-gap MEA electrolyzer; our purpose was to study and improve the ethylene partial oxidation reaction using a chloride-mediated mechanism. We provide NaCl electrolyte on each side, i.e. the initial catholyte and initial anolyte are each NaCl. We used $RuO_2$ for chloride-mediated ethylene partial oxidation at the anode, and obtained an encouraging full cell voltage of 2.7 V at 100 mA cm 2; this compared to the 4.5 V observed in the conventional three-compartment flow cell. The cathodic reaction with which we paired the anodic process was the hydrogen evolution reaction, for which we used Pt/C as the catalyst. Unfortunately, the Faradaic efficiency (FE) was only 42% towards ethylene chlorohydrin in the MEA configuration.

We noted that the local pH at the anode catalyst is expected to impact the relative rates of the desired chloride oxidation for mediated ethylene oxidation versus the undesired oxygen evolution reaction. In our studies, we used the neutral electrolyte NaCl. During the electrolysis, the catholyte is expected to alkalify and the anolyte to acidify as $Na^+$ transport across the cation exchange membrane and the reduction reaction produces $OH^-$, while chloride oxidation yields hydrochloric acid and hypochlorous acid.

It would be important to evaluate the actual local pH at the membrane-anode interface, operando. After we operated the device for 30 minutes continuously, the bulk pH of the anolyte descended to 1.5 (measured using a pH meter). To study the local pH at the membrane-anode interface, we used in situ photoluminescence based on a pH-sensitive dye anchored onto the membrane. After subtracting the background from the spectra collected during the in-situ photoluminescence experiment, we found that the local pH at the membrane-anode interface is in the range 5-6.

We noted the large $[OH^-]$ gradient across the membrane: this could potentially lead to $OH^-$ diffusion, from cathode to anode, and could account for the local alkalinity on the anode side of the membrane.

This possibility motivated us to study pH effects on the anodic ethylene oxidation. Rotating ring-disc electrode (RRDE) measurements in pH 1 vs. pH 6 showed that, in acidic conditions, the desired chloride oxidation reaction in mediated ethylene oxidation is the predominant reaction. In contrast, at pH 6, OER overtakes chloride oxidation. We propose that competitive adsorption occurs between hydroxide and chloride ions on the catalyst surface, and that—in the presence of a high local $[OH^-]$ concentration—hydroxide adsorption leads to oxygen evolution.

A Route to Decrease Local pH on the Anode: Using $CO_2$ Capture to Consume $OH^-$ We contemplated whether a cathodic reaction—an alternative to HER-might serve as a "sink" for $OH^-$, whose undesired counter-migration we posited was leading to the competitive adsorption between hydroxide and chloride ions on the anode catalyst. Better yet, we looked for an application that took advantage of, and consumed, this local flux of $OH^-$ on the cathodic side of the membrane.

$CO_2$ capture appeared to be a promising such reaction: it would benefit from $OH^-$ generation, leading to carbonate formation in the catholyte; and would consume $OH^-$ and thus limit the diffusive flux across the membrane.

We implemented the ORR reaction to produce $OH^-$ using iron single-atom catalysts (Fe—N—C), and proceeded to estimate, experimentally, the $CO_2$ capture efficiency: the ratio of {$OH^-$ consumed to convert $CO_2$ into carbonate} to {the number of cathodically-generated hydroxide ions} (Methods). While the anode is in direct contact with membrane, we introduced ~2 mm microfluidic channel between cathode and membrane to prevent salt precipitation.

We achieved a $CO_2$ capture efficiency of 91% at current density of 100 mA $cm^{-2}$. This was obtained when we used a gas feed stream composed of 10% $CO_2$, 20% $O_2$, and 70% $N_2$. Gas chromatography and $^1H$ nuclear magnetic resonance (NMR) spectroscopy revealed no detectable hydrogen or $CO_2$ reduction products—an expected result given that the oxygen reduction reaction is more favorable than $CO_2$ electroreduction/hydrogen evolution reaction.

When comparing ethylene oxidation paired with carbon capture versus hydrogen evolution in a microfluidic electrolyzer, introducing $CO_2$ into the cathode gas inlet led to a pH of 11.4 instead of 13.7 in the prior case of HER. Pairing ethylene partial oxidation on the anode with ORR for $CO_2$ capture on the cathode decreased the full cell voltage by over 1 V. When comparing the full cell voltage of ethylene oxidation coupled with ORR, both with and without carbon capture, we observed a decrease in cell voltage when carbon capture was implemented. This decrease can be attributed to a reduction in the pH gradient across the membrane, which in turn reduces the associated Nernst loss. Most strikingly, the FE for anodic ethylene partial oxidation increased from 40% to 71%, consistent with the hypothesis that using $OH^-$—with the goal of lowering $[OH^-]$ supply on the cathode side of the membrane, and thus lowering the pH gradient at the membrane interface-improved local conditions on the anode towards ethylene partial oxidation.

Anodic Catalyst Redesign to Maximize Chloride-Mediated Ethylene Oxidation

Since even the improved FE of 71% left considerable room for improvement, we pondered whether the catalyst could be better designed to prefer chloride oxidation over oxygen evolution under near-neutral condition. We used DFT to study CIER vs. OER selectivity of $RuO_2$ (110) and $RuMO_x$ (110) (M=V, W, Sn) by calculating the Gibbs free energy of chlorine ($\Delta G_{*O\rightarrow *OCl}$) and hydroxyl ($\Delta G_{*O\rightarrow *OOH}$) adsorption at pH 5. We find a nearly linear scaling relationship between $\Delta G_{*O\rightarrow *OCl}$ and $\Delta G_{*O\rightarrow *OOH}$; and further find dopants have a more pronounced effect on *OH over *Cl. Specifically, Sn doping slightly increases $\Delta G_{*O\rightarrow *OCl}$ but significantly raises $\Delta G_{*O\rightarrow *OOH}$, shifting selectivity from OER to CIER, making $RuSnO_x$ the most promising candidate for CIER at a near-neutral pH. $RuSnO_x$ is also projected to decrease Pourbaix energy and increase stability during chloride oxidation.

Experimentally we synthesized candidate catalysts using a hydrothermal method. Within the family considered in DFT, $RuMO_x$ (M=Sn, V, W), $RuSnO_x$ exhibited the highest ECSA-normalized chloride oxidation partial current density in rotating ring-disc electrode (RRDE) screening. We further tested the $RuMO_x$ for chloride-mediated ethylene oxidation at a constant potential of 1.8 V vs RHE. $RuSnO_x$ had a FE of 94% for ethylene chlorohydrin production, the highest among catalysts evaluated. When we analyzed the gaseous product using gas chromatography, we observed no measurable $CO_2$, indicating that overoxidation of ethylene was substantially avoided in chloride-mediated ethylene partial oxidation. We conducted cyclic voltammetry studies in a non-chloride electrolyte. There are no appreciable differences with vs. without ethylene; and no ethylene oxidation products were detected in the liquid electrolyte. These findings suggest that ethylene oxidation occurs through a chloride-mediated pathway in the solution rather than directly on the catalyst surface. $^{13}C$-labeled ethylene was applied to investigate any 1,2 dichloroethane formation. The $^{13}C$-NMR results suggest that 2-chloroethanol is the only product of chloride-mediated ethylene oxidation.

We sought to understand, with the aid of in-situ X-ray Absorption Spectroscopy (XAS), the chemical origins of the increased operating stability of $RuSnO_x$ relative to $RuO_2$. Across the wide range of applied anodic potentials from 1.0 to 1.8 V, ruthenium in $RuSnO_x$ is in a lower oxidation state than it is in $RuO_2$ under the same operating conditions. The addition of Sn thus appears to militate against over-oxidation known to contribute to the degradation of $RuO_2$.

We turned to in-situ Surface Enhanced Raman Spectroscopy (SERS) to study the binding energy of chloride ions, anticipating that this as a result of change in electronic structure and might correlate with the chloride oxidation activity. Cl adsorption on $RuSnO_x$ (271 and 335 $cm^{-1}$) is shifted to a lower wavenumber compared to that observed on $RuO_2$ (274 and 348 $cm^{-1}$), indicating a weaker *Cl binding on $RuSnO_x$ relative to $RuO_2$.

The influence of dopants on catalytic performance was further elucidated by analyzing the p-band center of the $O_c$ site. This showed a linear correlation between p-band center and $\Delta G_{*O \rightarrow *OCl}$. This suggests that Sn doping shifts the p bands away from the Fermi level, thereby weakening *Cl adsorption. A similar trend was observed with Bader charge analysis, where more negatively charged $O_c$ sites in $RuSnO_x$ make it less likely to accommodate electrons from $Cl^-$, thus reducing the adsorption strength of *Cl on $O_c$. Crystal orbital Hamilton population (COHP) analysis accords with this picture, for it shows a stronger Ru—$O_c$ bond in $RuSnO_x$, characterized by a shorter bond length and a lower integrated COHP value, this linked to weaker $O_c$—Cl binding.

Integrated System for Ethylene Glycol Electrosynthesis and Carbon Capture

We integrated chloride-mediated ethylene oxidation with carbon capture in a cation-exchange membrane-based microfluidic electrolyzer (FIG. 5). The anode is in direct contact with membrane while there is a ~2 mm microfluidic channel between cathode and membrane to prevent salt precipitation. When it was fed by using a 10% $CO_2$ stream, the system maintained >90% $CO_2$ capture efficiency below 100 mA $cm^{-2}$ current density. We further tested this down to 1% $CO_2$ concentration. The results reveal that at lower current densities, carbon capture efficiency is determined by the $OH^-$ ions generated at the cathode. At higher current densities, however, carbon capture correlates more directly with $CO_2$ concentration, with higher $CO_2$ concentrations leading to enhanced carbon capture efficiency. The system operated at a full cell voltage of 1.8 V and a current density of 100 mA $cm^{-2}$.

To produce ethylene glycol and release the captured $CO_2$, we mixed—outside the electrolyzer—the post-carbon capture catholyte with the anolyte. This led to hydrolysis of ethylene chlorohydrin to ethylene glycol accompanied by the regeneration of $CO_2$ and sodium chloride. The regenerated $CO_2$ was measured using a water displacement method. Ethylene glycol production rates ranged from 180 μmol $h^{-1}$ $cm^{-2}$ at 10 mA $cm^{-2}$, accompanied by 94% FE; to 1600 μmol $h^{-1}$ $cm^{-2}$ at 100 mA $cm^{-2}$ at 85% FE and $CO_2$ was regenerated at 4-118 ml $h^{-1}$ $cm^{-2}$. In-situ kinetic NMR showed that 95% conversion was achieved from {ethylene chlorohydrin and sodium carbonate} to {ethylene glycol and $CO_2$}. Active chlorine species were not detected in the liquid products nor in the regenerated $CO_2$ stream. Extending the hydrolysis time to 6 hours increased the overall conversion to 99%. We tested the integrated system at 100 mA $cm^{-2}$ for 15 hours, finding that the voltage remained in the range 1.85-1.89 V, that the FE to EG remained above 81%, and that the carbon capture efficiency was stable in the range 89-92%. High-resolution TEM characterization and EDS mapping of $RuSnO_x$ were carried out, these data indicating that morphology is retained following stability tests.

In light of ratio among the rates measured above, the system will, for every tonne of ethylene glycol produced, capture 0.75 tonnes of $CO_2$ (FIG. 6). A detailed process design was formulated and its energy consumption were calculated. Briefly, the system will require an estimated 12.7 GJ of energy per tonne of ethylene glycol). Existing thermocatalytic routes for ethylene-to-ethylene glycol, if coupled with liquid sorbents for the capture of the same 0.75 ton $CO_2$ per ton EG, will require an estimated 22.6 GJ per tonne EG (an estimated 20 GJ from the E to EG, and 2.6 GJ from $CO_2$ capture).

Traditionally, the production of one ton of ethylene glycol results in the emission of 1.2 tons of $CO_2$, with 0.8 tons arising from naphtha cracking to produce ethylene and 0.4 tons from ethylene overoxidation. When coupled with thermal naphtha cracking for ethylene production, the system contributes a gross negative $CO_2$ emission component of 0.71 ton/ton EG, assuming $CO_2$ sequestration. If we assume low-carbon-intensity wind electricity 2.86 $kgCO_2$ eq/GJ for the electrosynthesis, this leads to an estimated net cradle-to-grave carbon intensity of 0.13 $tonCO_2$ eq/tonEG, compared to the 1.2 $tonCO_2$ eq/tonEG global average for ethylene glycol today. Techno-economic analysis suggests that the coupled system has the potential to produce ethylene glycol at an estimated ~$520/tonEG compared to today's market price of $800-$1200/tonEG. The production cost breakdown of the base case suggests that feedstock, along with compression, separation, and sequestration, are the major contributors, followed by the electrolysis.

CONCLUSION

In this study, we demonstrated an electrochemical method for ethylene glycol production coupled with carbon capture in a single electrolyzer. The in-situ photoluminescence analysis revealed that the pH gradient across the electrolyzer membrane created a near-neutral microenvironment at the membrane-catalyst interface that adversely impacts ethylene oxidation efficiency. Seeking to address this, we integrated carbon capture at the cathode to mitigate $OH^-$ diffusion and developed a tin-doped ruthenium oxide catalyst to enhance ethylene oxidation selectivity. In-situ XAS, SERS coupled with DFT calculations suggest that tin doping increases the stability and activity of $RuSnO_x$ by tuning the oxidation state of ruthenium and promoting *Cl adsorption over *OH, thereby shifting selectivity towards chloride-mediated ethylene oxidation. The optimized system achieves 94% ethylene glycol FE and 91% carbon capture efficiency in a 10% $CO_2$ stream. The integrated system requires 12.7 GJ of energy per tonne ethylene glycol produced and captures 0.75 tonnes of $CO_2$, compared to the traditional 22.6 GJ. A cradle-to-gate analysis indicates that this approach can lower the carbon intensity of ethylene glycol production from fossil fuel-derived ethylene to 0.13 tonnes $CO_2$ eq per tonne EG.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more."

If not already included, all numeric values of parameters in the present disclosure are proceeded by the term "about" which means approximately. This encompasses those variations inherent to the measurement of the relevant parameter as understood by those of ordinary skill in the art. This also encompasses the exact value of the disclosed numeric value and values that round to the disclosed numeric value.

The foregoing description of illustrative embodiments of the disclosure has been presented for purposes of illustration and of description. It is not intended to be exhaustive or to limit the disclosure to the precise form disclosed, and modifications and variations are possible in light of the above teachings or may be acquired from practice of the disclosure. The embodiments were chosen and described to explain the principles of the disclosure and; as practical applications of the disclosure, to enable one skilled in the art to utilize the disclosure in various embodiments and with various modifications as suited to the particular use contemplated. It is intended that the scope of the disclosure be defined by the claims appended hereto and their equivalents.

In recognition of the inherent nature of electrochemical processes, throughout the present disclosure, terms and phrases such as "absence," "free," "does not comprise," "does not occur," etc. encompass, but do not require a perfect absence of the referenced entity.

The term "type" as used herein refers to chemical formula such that a single type means the same chemical formula and different type means different chemical formula. Similarly, use of "more" as in "one or more" refers to use of different types of the relevant entity. Terms such as "comprising" and the like may be replaced with terms such as "consisting" and the like.

What is claimed is:

1. A method for electrolyzing a hydrocarbon, the method comprising:

(a) delivering a cathode feed comprising $CO_2$ to a cathode in contact with a catholyte;

(b) delivering an anode feed comprising a hydrocarbon to an anode in electrical communication with the cathode and in contact with an anolyte;

(c) generating hydroxide in the catholyte to dissolve the $CO_2$ therein, while oxidizing the hydrocarbon in the anolyte, by generating a potential difference between the cathode and the anode; and (d) releasing $CO_2$ gas from the catholyte while producing an oxidation product from the anolyte, wherein (d) is carried out by combining a portion of the catholyte with a portion of the anolyte.

2. The method of claim 1, wherein the combining induces a reaction between a carbonate formed in the catholyte during (c) and an oxidation intermediate formed in the anolyte during (c).

3. A method for electrolyzing a hydrocarbon, the method comprising:

(a) delivering a cathode feed comprising $CO_2$ to a cathode in contact with a catholyte;

(b) delivering an anode feed comprising a hydrocarbon to an anode in electrical communication with the cathode and in contact with an anolyte; and (c) generating hydroxide in the catholyte to dissolve the $CO_2$ therein, while oxidizing the hydrocarbon in the anolyte, by generating a potential difference between the cathode and the anode, wherein the cathode feed further comprises $O_2$ and the hydroxide is generated via an oxygen reduction reaction.

4. The method of claim 3, wherein the catholyte comprises water and a salt, the salt comprising cations which form a carbonate in the catholyte during (c).

5. The method of claim 3, wherein the anolyte comprises water and a salt, the salt comprising anions which are oxidized during (c) to induce partial oxidation of the hydrocarbon to form an oxidation intermediate in the anolyte.

6. The method of claim 3, wherein the catholyte and the anolyte comprise an alkali metal halide salt.

7. The method of claim 3, wherein the $CO_2$ is present in the cathode feed at an amount of from 1% to 10% by volume.

8. The method of claim 3, wherein the anode comprises a mixed oxide catalyst comprising at least two transition metals.

9. The method of claim 3, wherein the cathode, the anode, and a separator form a membrane electrode assembly wherein the cathode is in direct contact with one side of the separator and the anode is in direct contact with an opposing side of the separator.

10. The method of claim 9, wherein the separator is a cation exchange membrane.

11. The method of claim 3, wherein the hydrocarbon is ethylene and the method produces ethylene glycol, ethylene oxide, or both.

12. The method of claim 3, wherein the catholyte comprises water and a salt, the salt comprising cations which form a carbonate in the catholyte during (c); and wherein the anolyte comprises water and the salt, the salt further comprising anions which are oxidized during (c) to induce partial oxidation of the hydrocarbon to form an oxidation intermediate in the anolyte.

13. The method of claim 12, further comprising (d) releasing $CO_2$ gas from the catholyte while producing an oxidation product from the anolyte by combining a portion of the catholyte with a portion of the anolyte.

14. A method for electrolyzing a hydrocarbon, the method comprising:

(a) delivering a cathode feed comprising $CO_2$ to a cathode in contact with a catholyte;

(b) delivering an anode feed comprising a hydrocarbon to an anode in electrical communication with the cathode and in contact with an anolyte; and (c) generating hydroxide in the catholyte to dissolve the $CO_2$ therein, while oxidizing the hydrocarbon in the anolyte, by generating a potential difference between the cathode and the anode, wherein the anode comprises a mixed oxide catalyst comprising at least two transition metals, further wherein the mixed oxide catalyst has a ruthenium oxide lattice in which a transition metal M is incorporated, wherein M is selected from V, W, Mn, and Sn.

* * * * *